US010436003B2

(12) United States Patent
Kim et al.

(10) Patent No.: US 10,436,003 B2
(45) Date of Patent: Oct. 8, 2019

(54) FLUID BLOCKING ANALYSIS AND CHEMICAL EVALUTION

(71) Applicants: Jihye Kim, Sugar Land, TX (US); Ahmed Gomaa, Spring, TX (US); Scott G. Nelson, Cypress, TX (US); Harold Hudson, Tomball, TX (US); Qi Qu, Spring, TX (US)

(72) Inventors: Jihye Kim, Sugar Land, TX (US); Ahmed Gomaa, Spring, TX (US); Scott G. Nelson, Cypress, TX (US); Harold Hudson, Tomball, TX (US); Qi Qu, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 195 days.

(21) Appl. No.: 15/381,817

(22) Filed: Dec. 16, 2016

(65) Prior Publication Data

US 2017/0198573 A1 Jul. 13, 2017

Related U.S. Application Data

(60) Provisional application No. 62/268,782, filed on Dec. 17, 2015.

(51) Int. Cl.
*E21B 43/26* (2006.01)

(52) U.S. Cl.
CPC ..... *E21B 43/26* (2013.01)

(58) Field of Classification Search
CPC ..... E21B 43/26
See application file for complete search history.

(56) References Cited

U.S. PATENT DOCUMENTS 7,257,490 B2 * 8/2007 Georgi ..... G01V 11/00 702/11
9,133,709 B2 * 9/2015 Huh ..... E21B 47/1015
(Continued)

FOREIGN PATENT DOCUMENTS

WO 20140020061 A1 2/2014

OTHER PUBLICATIONS

Jihye Kim et al., "Engineering Hydraulic Fracturing Chemical Treatment to Minimize Water Blocks: A Simulated Reservoir-on-a-Chip Approach"; SPE Paper 178959-MS; Feb. 24, 2016; 18 pages.
(Continued)

*Primary Examiner* — John Fitzgerald
(74) *Attorney, Agent, or Firm* — Cantor Colburn LLP

(57) ABSTRACT

An embodiment of a method of evaluating fluid trapping in an earth formation includes injecting a water-based fluid into at least one fluid channel fabricated on a substrate, the at least one fluid channel having a pore structure configured to represent a condition of an earth formation. The method also includes injecting oil into an inlet of the at least one fluid channel until at least a selected amount of the injected oil exits the channel, imaging the fluid channel and determining an amount of remaining fluid in the fluid channel after injection of the oil, the remaining fluid being an amount of the oil and/or an amount of the water-based fluid, and estimating a proportion of the total volume of the fluid channel occupied by the remaining fluid to determine an amount of fluid trapping in the pore structure. The method further includes analyzing the amount of fluid trapping.

20 Claims, 13 Drawing Sheets

(56) References Cited

U.S. PATENT DOCUMENTS

| | | | | |
|---|---|---|---|---|
| 9,291,050 | B2 * | 3/2016 | Seleznev | G01V 3/26 |
| 2006/0276969 | A1 * | 12/2006 | Georgi | G01V 11/00 702/11 |

OTHER PUBLICATIONS

Xia et al., "Soft Lithography"; Department of Chemistry and Chemical Biology, Harvard University; Annu. Rev. Mater. Sci. 1998. 28:153-84; downloaded from arjournals.annualreviews.org on Jan. 23, 2006; 33 pages.

He et al.; "Validating Surfactant Performance in the Eagle Ford Shale: A Correlation between the Reservoir-on-a-Chip Approach and Enhanced Well Productivity"; SPE-169147; 2014; Society of Petroleum Engineers; 7 pages.

Conn, et al.; "Visualizing Oil Displacement with Foam in a Microfluidic Device with Permeability Contrast"; The Royal Society of Chemistry; 2014; Lap on a Chip; 10 pages.

Berejnov, et al.; "Lab-on-chip Methodologies for the Study of Transport in Porous Media: Energy Applications"; The Royal Society of Chemistry; Lab Chip; 2008; 5 pages.

* cited by examiner

FLUID BLOCKING ANALYSIS AND CHEMICAL EVALUTION

CROSS REFERENCE TO RELATED APPLICATIONS

This application claims the benefit of an earlier filing date from U.S. Provisional Application Ser. No. 62/268,782 filed Dec. 17, 2015, the entire disclosure of which is incorporated herein by reference.

BACKGROUND

During energy industry operations, such as drilling, completion and stimulation (e.g., hydraulic fracturing), water-based fluids pumped into a borehole invade the surrounding formation and can cause fluid retention issues. Water block trapping is one of the major causes of damage after any treatment if the fluids remain in the pore space. Especially in hydraulic fracturing, the water blocks formed in the area surrounding the fracture and within the fracture have a detrimental effect on relative permeability and effective fracture lengths, thus reducing hydrocarbon permeability and well productivity. Over time, the hydrocarbon production rate may increase, but it can take many hours or up to a year to establish optimum production rate following fluid injection into the formation. In some cases, sensitive formations with very low permeability may never reach an economical producing rate.

Fracturing fluid trapping is one of the major sources of damage after well stimulation as the remaining fluids in the pore space reduce the effective hydrocarbon permeability. Especially in tight formations, fluid trapping can require significant time to clean up, even at a high production rate. Outcrop cores have traditionally been used to confirm the existence of damage and to quantify it. However, it is difficult to clearly discern the trapping mechanism in cores and to accurately determine the trapping location and the volume of residual fluid.

SUMMARY

An embodiment of a method of evaluating fluid trapping in an earth formation includes injecting a water-based fluid into at least one fluid channel fabricated on a substrate, the at least one fluid channel having a pore structure configured to represent a condition of an earth formation subject to an energy industry operation, the at least one fluid channel including a plurality of pores having a selected diameter and connected by pore throats. The method also includes injecting oil into an inlet of the at least one fluid channel until at least a selected amount of the injected oil exits the channel, imaging the fluid channel and determining an amount of remaining fluid in the fluid channel after injection of the oil, the remaining fluid selected from at least one of an amount of the oil remaining in the fluid channel and an amount of the water-based fluid remaining in the fluid channel, and estimating a proportion of the total volume of the fluid channel occupied by the remaining fluid to determine an amount of fluid trapping in the pore structure. The method further includes analyzing the amount of fluid trapping, where analyzing includes determining whether a chemical treatment is to be included as part of the energy industry operation and/or determining an effectiveness of the water-based fluid for use in the energy industry operation based on the proportion.

An embodiment of a system for evaluating fluid trapping in an earth formation includes a substrate having at least one fluid channel fabricated thereon, the at least one fluid channel having a pore structure configured to represent a condition of an earth formation subject to an energy industry operation, the at least one fluid channel including a plurality of pores having a selected diameter and connected by pore throats. The system also includes an injection device configured to inject a water-based fluid into on a substrate, and subsequently inject oil into an inlet of the at least one fluid channel until at least a selected amount of the injected oil exits the channel, and an imaging device configured to image the fluid channel and determine an amount of remaining fluid in the fluid channel after injection of the oil, the remaining fluid selected from at least one of an amount of the oil remaining in the fluid channel and an amount of the water-based fluid remaining in the fluid channel. The system further includes a processor configured to perform: estimating a proportion of the total volume of the fluid channel occupied by the remaining fluid to determine an amount of fluid trapping in the pore structure, the amount of fluid trapping analyzed to determine at least one of: whether a chemical treatment is to be included as part of the energy industry operation, and an effectiveness of the water-based fluid for use in the energy industry operation based on the proportion.

BRIEF DESCRIPTION OF THE DRAWINGS

The following descriptions should not be considered limiting in any way. With reference to the accompanying drawings, like elements are numbered alike.

DETAILED DESCRIPTION

Systems and methods are provided for evaluating formation or reservoir conditions and/or evaluating fluids to be used in energy industry operations. Embodiments of an apparatus for analyzing formation fluid structures and fluids used in energy industry operations are provided for visualizing the behavior of different fluids in various pore structures and, e.g., estimate the residual water blocking (i.e., water trapping) process of fluids such as fracturing fluids. An embodiment of the apparatus includes one or more fluid channels that are fabricated (e.g., on a micro- or nano-scale) on a substrate using lithography or other methods. An embodiment of a method includes successively injecting oil and water or water-based fluids into the fluid channel(s) to evaluate fluid blocking or fluid trapping (or oil trapping, e.g., in EOR applications) in different pore structures, identify conditions for which chemical treatment is appropriate, and/or determine how well additives or chemicals, such as surfactants, can alleviate severe fluid block conditions. Fluid trapping or blocking may refer to water trapping (i.e., an amount of water trapped in the channel), water-based fluid trapping (i.e., an amount of water trapped in the channel) and/or oil trapping (i.e., an amount of oil or hydrocarbon fluid trapped in the channel).

Figure 1:
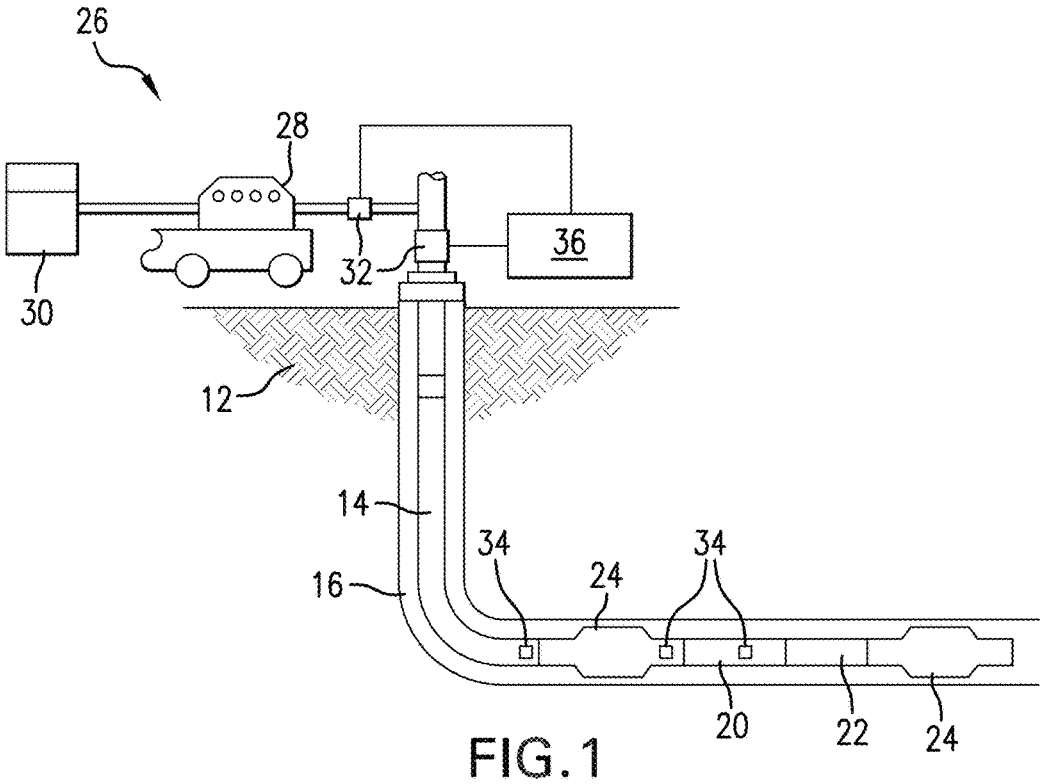
FIG. 1 depicts an embodiment of a formation stimulation and/or production system.

Referring to FIG. 1, an exemplary embodiment of a system 10 for performing energy industry operations is shown. The system 10, in the embodiment of FIG. 1, is a hydrocarbon production and/or stimulation system 10 configured to produce and/or stimulate production of hydrocarbons from an earth formation 12. The system 10 is not so limited, and may be configured to perform any energy industry operation, such as a drilling, stimulation, measurement and/or production operation.

A borehole string 14 is configured to be disposed in a borehole 16 that penetrates the formation 12. The borehole 16 may be an open hole, a cased hole or a partially cased hole. In one embodiment, the borehole string 14 is a stimulation or injection string that includes a tubular, such as a coiled tubing, pipe (e.g., multiple pipe segments) or wired pipe, that extends from a wellhead at a surface location (e.g., at a drill site or offshore stimulation vessel). As described herein, a "string" refers to any structure or carrier suitable for lowering a tool or other component through a borehole or connecting a drill bit to the surface, and is not limited to the structure and configuration described herein. The term "carrier" as used herein means any device, device component, combination of devices, media and/or member that may be used to convey, house, support or otherwise facilitate the use of another device, device component, combination of devices, media and/or member. Exemplary non-limiting carriers include casing pipes, wirelines, wireline sondes, slickline sondes, drop shots, downhole subs, BHAs and drill strings.

In one embodiment, the system 10 is configured as a hydraulic stimulation system. As described herein, "hydraulic stimulation" includes any injection of a fluid into a formation. A fluid may be any flowable substance such as a liquid or a gas, and/or a flowable solid such as sand. In this embodiment, the string 14 includes a stimulation assembly 18 that includes one or more tools or components to facilitate stimulation of the formation 12. For example, the string 14 includes a fracturing assembly 20, such as a fracture or "frac" sleeve device, and/or a perforation assembly 22. Examples of the perforation assembly 22 include shaped charges, torches, projectiles and other devices for perforating the borehole wall and/or casing. The string 14 may also include additional components, such as one or more isolation or packer subs 24.

In one embodiment, the system 10 is configured to perform one or more enhanced oil recovery (EOR) techniques. Such techniques include, for example, gas injection, thermal injection (e.g., steam injection) and chemical injection.

One or more of the stimulation assembly 18, the fracturing assembly 20, the perforation assembly 22 and/or packer subs 24 may include suitable electronics or processors configured to communicate with a surface processing unit and/or control the respective tool or assembly.

The system 10 includes surface equipment 26 for performing various energy industry operations. For example, the surface equipment 26 is configured for injection of fluids into the borehole 16 in order to, e.g., fracture the formation 12. In one embodiment, the surface equipment 26 includes an injection device such as a high pressure pump 28 in fluid communication with a fluid tank 30, mixing unit or other fluid source or combination of fluid sources. The pump 28 injects fluid into the string 14 or the borehole 16 to introduce fluid into the formation 12, for example, to stimulate and/or fracture the formation 12. The pump 28 may be located downhole or at a surface location.

One or more flow rate and/or pressure sensors 32 may be disposed in fluid communication with the pump 28 and the string 14 for measurement of fluid characteristics. The sensors 32 may be positioned at any suitable location, such as proximate to (e.g., at the discharge output) or within the pump 28, at or near the wellhead, or at any other location along the string 14 or the borehole 16. The sensors described herein are exemplary, as various types of sensors may be used to measure various parameters. Other sensors may be incorporated downhole, such as pressure and/or temperature sensors 34.

A processing unit 36 may be disposed in operable communication with downhole components such as the sensors 32, the sensors 34 and/or the pump 28. In one embodiment, the processing unit 36 communicates with downhole components via a communication borehole as discussed further below.

The processing unit 36 is configured to receive, store and/or transmit data generated from the sensors 32 and/or the pump 28, and includes processing components configured to analyze data from the pump 28 and the sensors, provide alerts to the pump 28 or other control unit and/or control operational parameters. The processing unit 36 includes any number of suitable components, such as processors, memory, communication devices and power sources.

Figure 2:
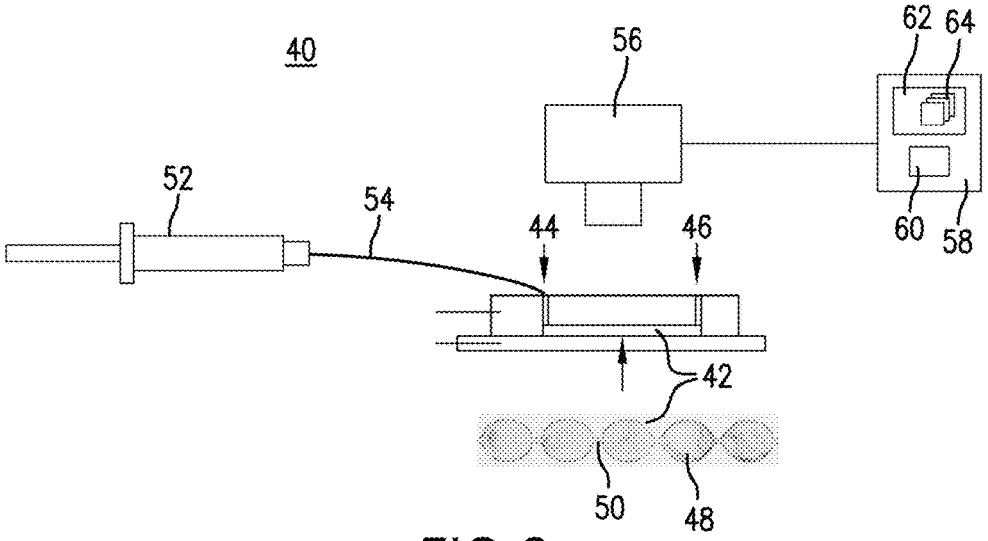
FIG. 2 depicts an embodiment of an apparatus for estimating water trapping in a pore structure.

FIG. 2 illustrates an embodiment of an experimental apparatus 40 or assembly for estimating fluid blocking or trapping associated with different types of fluids and/or different pore structures. Utilizing this tool, the effect of various factors on fluid trapping and the cleanup of fluid blocks in low-permeability reservoirs, as well as the impact of fluid blocking on well deliverability, can be systematically analyzed.

As described herein "fluid blocking" or "fluid trapping" refers to an amount of water, oil and/or a water-based fluid (e.g., fracturing fluid and/or a fluid injected as part of EOR) or other fluid injected in a formation (during a stimulation or other operation) that becomes trapped in pores in the formation and can inhibit hydrocarbon production. Fluid blocking or trapping may include water blocking or trapping, which refers to an amount of a water-based fluid trapped in the pores. Fluid blocking or trapping may also include oil blocking or trapping, which refers to an amount of hydrocarbon fluid (e.g., oil, gas and/or a mixture of oil and gas) trapped in the pores. Thus, it is understood that water blocking may refer to water, a mixture of water and other fluids, or any type of water-based fluid that is in a formation or injected into the formation, and is not limited to only water. Discussions herein of injecting water and determining amounts of trapped water are understood to include any water-based fluid desired to be evaluated. In addition, discussions of determining amounts of trapped water may be applied to determining trapped oil.

Water trapping is caused by capillary forces in porous rock that are higher than the drawdown pressure, and the high mobility ratio of hydrocarbon and water. After a stimulation and/or EOR treatment, hydrocarbon rapidly breaks through the water that remains around the wellbore when the well is placed on production. The hydrocarbon flows in the direction of least resistance, so it breaks through the fluid in one place and flows there, leaving a large portion of the injected water trapped in the formation. Looking into the water trapping process in pore scale, the hydrocarbon first wets the oil-wet rock surface, then surrounds the water in the pore, and breaks the water into smaller water blocks isolated inside the pore. This trapped water is difficult to recover and can take a long time to clean up.

Water trapping is related to the phenomena of capillary pressure (or Laplace pressure) and relative permeability, which are directly related to pore geometry, interfacial tension between the hydrocarbon and the water-based stimulation fluid, wettability, fluid saturation levels, depth of invasion, fluid penetration, reservoir temperature, pressure and/or drawdown potential.

The apparatus 40 allows for the study of fluid retention in an oil-water system within the reservoir pore space (as opposed to within a fracture). The apparatus 40 provides a simplified representation of the pore space, to allow for evaluation of formation properties and individual properties or parameters that can affect water trapping. This evaluation is otherwise difficult to achieve in the field, where reservoir conditions with high heterogeneity in the reservoir pore-matrix (e.g. pore size, pore throat size, connectivity between pores, and tortuosity) makes it difficult to investigate the effect of the individual parameters affecting water trapping.

The apparatus 40 includes a fluid channel 42 having an inlet 44 for introducing fluid into the fluid channel 42 and an outlet 46. The fluid channel includes a plurality of pores 48 connected by pore throats 50. In this embodiment, the channel includes an array of individual pores connected sequentially by pore throats to form a chain of individual pores, which can be configured along a straight linear path, but are not so limited. The pores can be connected in any suitable manner, having any number of pores in any configuration.

The apparatus 40 may include multiple fluid channels 42, each of which can be individually and independently evaluated by injecting fluids. In one embodiment, the apparatus 40 includes multiple fluid channels 42, each with a different combination of pore structure parameters such as pore size, pore shape and pore throat size. In one embodiment, the fluid channel 42 is a micro-pore channel having pores having diameters in the range of microns (μm) or a nano-meters (nm).

For example, a reservoir pore space can be simplified to multiple fluid channels 42 (e.g., 12 channels), each having different pore geometries. Each channel includes a selected number (e.g., ten) of pores of the same pore diameter and pore throat geometry with an inlet and an outlet for accessibility to the testing fluids. One or more channels could have different pore diameters and/or throats within the same channel, e.g., to simulate more heterogeneous formation structures.

A fluid injection device 52 such as a syringe is connected to a fluid conduit 54 (e.g., tubing) configured to advance fluid (e.g., oil, gas, water, stimulation fluid, etc.) into the fluid channel 42. An imaging device 56 such as a camera or video camera is configured to take still images and/or video, which can be transmitted to an analysis unit 58. The analysis unit 58 includes a processor 60 and a memory 62 and stores one or more processing modules or programs 64 for processing images, determining areas/volumes of different fluids in the channel and/or evaluating fluid behavior. The analysis unit 58 may also perform other functions, such as controlling fluid injection parameters (e.g., fluid type, pressure and flow rate through the channel) and timing of injection of different fluids. The analysis unit 58 may also be configured to provide experimental results and other data to a user and/or other device. For example, the data can be transmitted to an operator or control device (e.g., the processing unit 36 of FIG. 1) for purposes of planning stimulation or other operations and/or controlling operational parameters of such operations.

Figure 3:
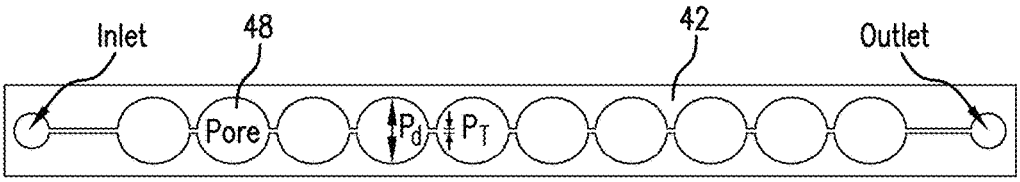
FIG. 3 depicts an example of a fluid channel that is part of the apparatus of FIG. 2.

FIG. 3 shows an example of a fluid channel 42 that includes ten pores of the same pore diameter and pore throat geometry with an inlet and an outlet for accessibility to the testing fluid. To mimic the actual reservoir conditions with high heterogeneity in reservoir pore-matrix, the channel design can be modified with different size of pores ($P_d$) and pore throats ($P_T$), various pattern of connectivity between pores and tortuosity. The surface wettability can be modified using surface modifier.

In the example of FIG. 3, the fluid channel 42 is a microfluidic (mF or μF) reservoir channel having a pore structure that represents a simplified version of a sandstone reservoir porous matrix. The pore throat $P_T$ in this example ranges from about 20 to about 100 μm, and the pore diameter Pa ranges from about 100 to about 1000 μm. As discussed further herein, the pore throat and/or pore diameter may be substantially constant within a single fluid channel or variable within the fluid channel. The fluid channel may be one of a plurality of fluid channels in the apparatus 40.

Various fluid systems with any combination of oil/gas/water can be tested at specific flow rates or drawdown pressures. The degree of fluid retention in the pore after water and/or chemical displacement can be quantified as the proportion or percentage of water in the pores (the water block or water block percentage) with respect to each set of testing conditions and the chemicals tested using image analysis. With the collected water block percentage values with different testing chemicals, the chemical performance of different chemicals and/or concentrations of chemicals in fluid can be relatively compared and the chemical and/or concentration with better performance in prevent water blocks or in water block removal can be determined.

The fluid channel 42 may be fabricated or manufactured using any suitable process. For example, the fluid channel can be fabricated using soft lithography. The following is a description of an example of a fluid channel fabrication process, which is provided for illustrative purposes and is not intended to be limiting. For example, the fluid channels and/or the apparatus may be fabricated using any suitable materials and any suitable fabrication method to achieve a pore structure in the micro- or nano-scale.

In this example, a silicon wafer is evenly coated with a pre-polymer and placed under a mask design in a conformal contact and is exposed to ultra-violet (UV) light. The UV light passes through the open transparent feature in the design on the mask, and crosslinks the exposed portion of the pre-polymer, transferring the pattern of the mask onto the substrate on the surface of the wafer. After removing unpolymerized pre-polymer on the wafer, only the feature of the fluid channel design remains on the wafer.

Prebaking and post baking (e.g., at 65° C. and 95° C.) are performed on the coated wafer before and after UV exposure. After the post baking step, a hard baking (e.g., at 250° C. for about 5 minutes) bonds the patterned structure more strongly on the wafer. The patterned wafer may then be exposed to silane vapor (Tridecafluoro-1,1,2,2-tetrahydro-octyl-methyl-bis(dimethylamino)silane) for a period of time (e.g., 2 hours) to coat the surface of the wafer with the protrudent features and to prevent the features falling out of the wafer in the process of replication of a mold with a polymer material such as Poly(dimethylsiloxane) (PDMS). PDMS and a crosslinker (1:10 wt % ratio) are poured onto the mold and cured in an oven, e.g., at 65° C. for 1 to 2 hours.

The apparatus 40 including the pore channel 42 is then fabricated by bonding a cover glass slide and the PDMS slab, which has the imprint of the microfluidic channel design, with partially crosslinked PDMS. This partially crosslinked PDMS is prepared by coating the fresh PDMS on the cover glass slide using a spin coater and by curing in the oven (e.g., at 65° C. for 7 to 10 mins) until it becomes dry, while still having adhesion to bond the channel containing PDMS slab. After the PDMS slab with the microfluidic channel imprint is placed above the partially crosslinked PDMS on the cover glass slide, it is placed in the oven (e.g., at 65° C. for 1 day) until it completely cures.

The natural wettability of the PDMS device made in this way is slightly hydrophobic (0=99.8°±5.3°), so that water trapping can be rendered in the manner that oil wets the channel surface, displaces the water, and eventually traps the water residue inside pores.

The apparatus 40 allows for screening individual micropore channels to investigate the effects of different geometries (e.g., pore diameter and pore throat). In this way, the reservoir conditions and flow conditions causing severe water blockage can be identified, and the degree of fluid retention in reservoir pores can be quantified into the percentage of water blockage in the pores with respect to each of the test conditions.

The addition of alcohol, surfactant, and surface wettability alteration using neutral wet or hydrophobic coatings are common chemical treatments to reduce water block fluid retention issues by reducing capillary pressure. As discussed further below, the apparatus can be used to consider potential treatments for high water blockage conditions. For example, chemical surfactant treatments can be performed on the fluid channel(s) to understand how they perform in actual reservoir pore scales to reduce water blocks, along with their capabilities and limitations.

Figure 4:
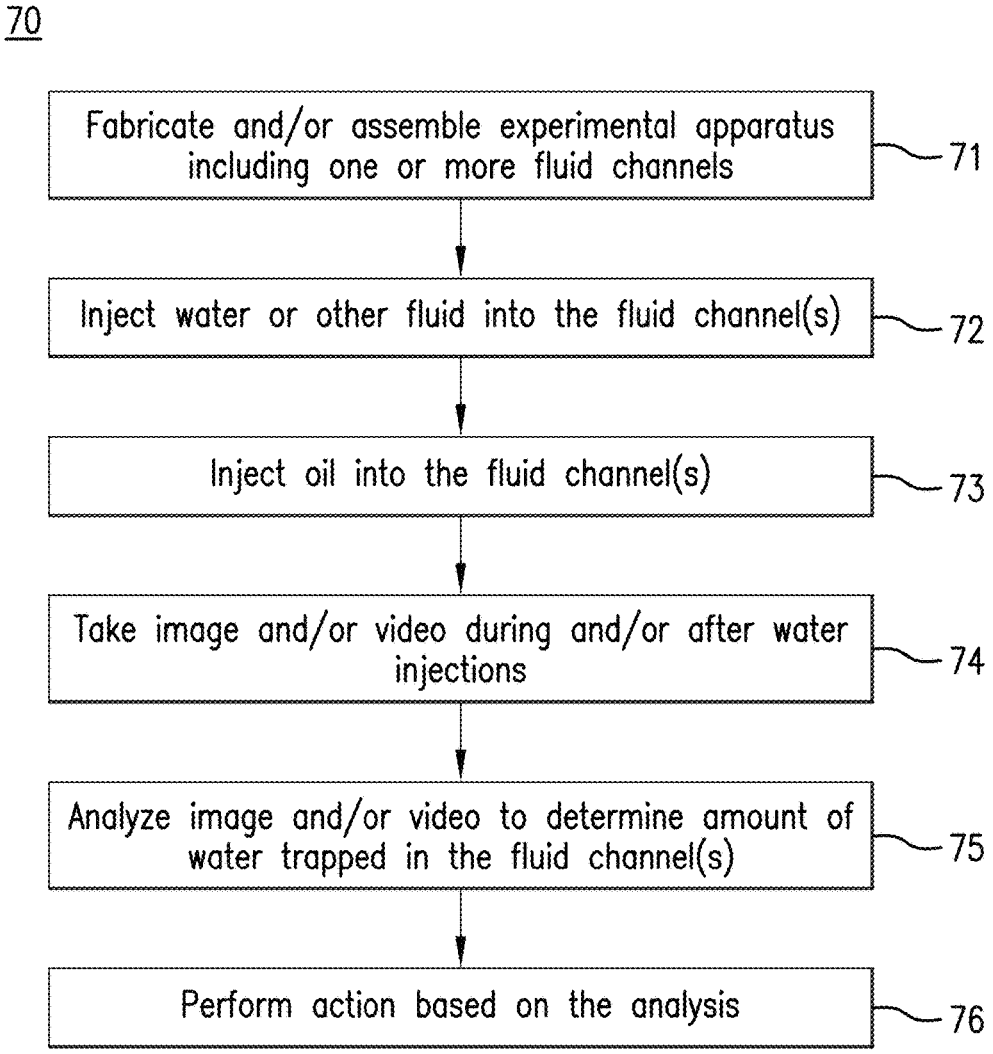
FIG. 4 is a flow chart illustrating an embodiment of a method of evaluating formation pore structure properties and/or fluids used in energy industry operations.
Figure 5A:
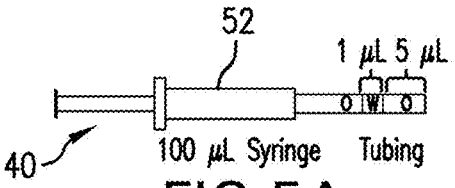
FIGS. 5A-5E depict aspects of an example of an apparatus and method for evaluating formation pore structure properties and/or fluids.
Figure 5C:
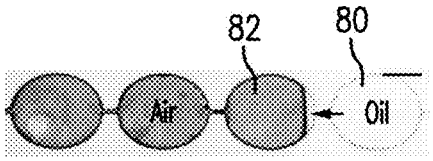
Figure 5B:
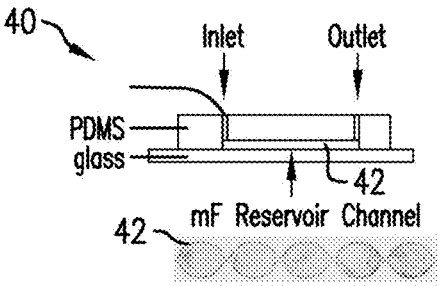
Figure 5D:
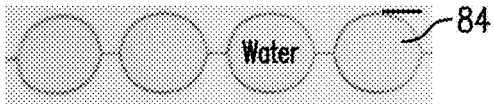
Figure 5E:
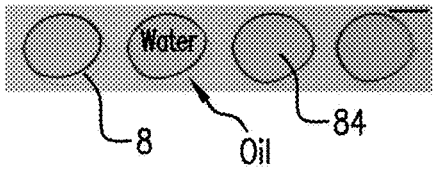

FIG. 4 is a flowchart depicting an exemplary method 70 of evaluating formation pore structure properties and/or fluids used in energy industry operations. The method 70 may be performed using any suitable processor, processing device and/or network, such as the analysis unit 58. The method 70 includes one or more stages 71-76. In one embodiment, the method 70 includes the execution of all of stages 71-76 in the order described. However, certain stages may be omitted, stages may be added, or the order of the stages changed.

The method 70 is discussed in conjunction with an example of an experimental setup and fluid channel images shown in FIGS. 5A-5E. The example of FIGS. 5A-5E is provided for illustration purposes and is not intended to limit the method 70 to any particular combination of fluids, pore structures and experimental equipment.

The reservoir pore structure in this example was designed using AutoCAD. The microfluidic (mF) reservoir channel of FIGS. 5A-5E includes 10 identical pores connected with pore throats. One inlet and an outlet are attached to the first and the last pore to deliver fluids in and out of the channel. To investigate the effect of reservoir pore geometry, 12 channels were designed with various diameters of pores ($P_d$) and widths of pore throats ($P_T$). Among these, 6 channels had a fixed $P_d$ to 500 μm with different $P_T$ in the range of 20 to 100 μm, which is pertinent to the size of the pore throats in sand stone. Another 6 channels were designed with a fixed $P_T$ to 50 μm with different $P_d$ in the range of 100 to 1000 μm. Each channel was made of 10 identical pores and pore throats with a size chosen within the ranged provided without mixing different pore or pore throat sizes within the channel. The height of the microfluidic reservoir pore structure was kept at 100 μm. The volume of the each pore was designed to be in the range of 1 to 86 nano-liters (nL), and the pore volume (PV) of each 10-pore channel was in the range of 10 to 864 nL. It is worth noting that the channel was squared when seen in a lateral cutting image with a height of 100 μm, and gravitational effects are negligible for the microfluidic reservoir channel layer, which was laid on a flat surface.

As the oil phase, four fluids with different viscosities were used: mineral oil having a viscosity of 30 centistokes (cSt), silicon oil (5, 20 cSt), and isopar L (1.5 cSt) to assess the effect of oil viscosity. As the aqueous phase, 2% green dye solution was used, occasionally with a surfactant (S-1 or S-2), depending on the purpose of the test. The injection flow rate of the reservoir fluid (oil) was 0.1 to 1 μL/min.

As shown in FIGS. 5A-5E, fluid was prepared inside a tygon tubing in the sequence of oil (5 to 10 μt), water (1 μL), and oil (for the rest of the volume in tubing and syringe) from the tubing tip to the syringe using the withdraw feature on a syringe pump. The tubing tip was inserted into the inlet on the mF reservoir channel. A constant rate of fluid volume or pressure can be injected into the channel by using a syringe pump at the rate of Q=0.1 to 1 μL/min. The imaging device included a stereo microscope, and movies were recorded with a digital camera.

In the first stage 71, an apparatus including one or more fluid channels such as one or more of the fluid channels 42 is manufactured and/or fabricated to have properties similar to the reservoir structure of a formation to be operated on. In one embodiment, the fluid channels are fabricated with pores having a micro- or nano-scale using a lithology technique.

Optionally, an oil is initially injected into the fluid channel(s) until the pores are saturated. For example, oil 80 is injected into the fluid channel 42 of FIGS. SA-SE that was originally filled with air 82. The oil, (e.g., as a first fluid in a prepared sequence in the tubing 54) is dispensed from the tubing and pushes the air 82 out of the channel. The oil 80 saturates the channel for a period of time (e.g., 5 min) until the next sequence of the fluid, water, is dispensed.

In the second stage 72, a water-based fluid (which can be only water or a solution of water and one or more other fluids) is injected into the fluid channel. In the example of FIGS. 5A-5E, water 84 having a green dye (or other substance configured to make the water more visible) fills the channel 42.

The water-based fluid may include a chemical additive such as an additive (e.g. nano-particles, designer particles, multiple emulsion) that modifies interfacial properties and/or enhances the performance of other additives (e.g. surfactant) to reduce water trapping in porous media In the third stage 73, oil is injected into the fluid channel(s) to displace the water-based fluid. In the example of FIGS. 5A-5E, the last sequence of the fluid, an oil 86 is injected and starts pushing the water out of the pores until at least a selected amount of the injected oil exits the channel. After this final displacement of oil 86, some water 84 (the water block or blockage) is trapped in the pores surrounded by transparent oil. Depending on the fluid and reservoir conditions, the oil displaces the water by 0 to 100% with or without any chemical treatment.

In the fourth stage 74, one or more images and/or video of the channel is taken during and/or after injection of the fluids. Still images may be taken at various times to show the proportion of the water-based fluid remaining in the pores and/or show the progression of oil and/or water-based fluid through the fluid channel. Video may also be taken to show the progression. In the example of FIGS. 5A-5E, a movie of the water injection process is recorded with a final picture showing how much water remains trapped under the specific testing condition.

In the fifth stage 75, the image(s) and/or video is analyzed to determine an amount of a fluid (e.g., the water-based fluid or the oil) remaining in the pores. For example, the amount of water or the water-based fluid that remains trapped in the fluid channel is determined. The percentage or proportion of water-based fluid remaining is estimated to determine an amount or degree of water trapping.

In the example of FIGS. 5A-5E, the movie and picture taken are analyzed using the image for an area analysis of each water block trapped inside the pores to calculate the water block in each pore as a percentage that equals $V_{WB}/V_p \times 100$, where $V_{WB}$ is the volume of the water trapped and $V_p$ is the volume of the pore. Stages 72-75 may be repeated using the same testing condition (e.g., 1 to 5 times) to calculate an average water block percentage. Stages 72-75 can be repeated any number of times for any of various combinations of pores structures, fluid types and flow rates.

Based on the water block percentage, various formation properties and their effect on water trapping may be evaluated or investigated. For example, formation properties such as the pore geometry, reservoir/stimulation fluid properties and flow rate, are investigated to understand the severity of water block trapping as a result of these properties.

In the sixth stage 76, various actions can be performed based on the analysis described herein. Such actions include, for example, displaying analysis results and/or other data related to the method to a device or user, such as an analysis report. Other actions include selecting parameters of a fracturing or other energy industry operation based on the results, such as the type of fluid, type of chemical treatment, concentration of a surfactant or other treatment chemical to be used in the operation. Further actions include planning operational parameters such as pumping volume, pumping rate, treatment location, drilling parameters, etc.

In one embodiment, the method 70 can be performed to determine an amount of oil trapping or oil blocking (in place of or in addition to determining an amount of water trapping). For example, the method 70 is performed as discussed above, except that the images and/or video are taken to show the proportion of the oil remaining in the pores, and the analysis of stage 75 is performed to estimate a percentage or proportion of oil remaining in the pores to determine an amount or degree of oil trapping. In this embodiment, the fluid channel can optionally treated with a material or coating (a hydrophilic material or coating) that causes surfaces of the fluid channel to be at least somewhat hydrophilic.

The method may be used as part of a fluid mechanical study to determine which reservoir conditions require chemical treatments to mitigate water or fluid blocks, and/or a chemical evaluation study to determine how well chemicals such as surfactants, surface wettability modifiers and any water block relieving chemicals can alleviate severe water block conditions.

The method 70 using a reservoir-on-a-chip or other fabricated fluid channel may be used to evaluate the performance of chemicals used for capillary pressure reduction (such as surfactants and surface modifier agents) which will improve water block cleanup. The method gives a clear visualization of fluid displacement and water block trapping process in the micro-pore scale. In addition, the approach enables control of testing parameters including formation wettability, reservoir/stimulation fluid properties, flow rate, and reservoir pore-space geometry. Utilizing the method, systematic evaluation of chemicals on the performance of water block cleanup can be conducted under various reservoir pore structure and flow conditions.

FIGS. 6A-6D through 20 illustrate aspects of various examples of the use of the apparatus and methods for analyzing pore structures and fluids.

FIGS. 6A-6D through 11 illustrate examples that show the effect of various formation or reservoir conditions, such as pore structures and/or formation fluid (e.g., oil) properties on water trapping. These examples facilitate fluid mechanical understanding to determine which reservoir conditions require or would benefit from chemical treatments to mitigate water blocks in a slightly oil-wet reservoir condition. Parameters such as reservoir pore-space geometries (pore throat and pore size), reservoir fluid property, and production flow rate are investigated to determine their effect on the water blockage in the pore matrix.

Figure 6A:
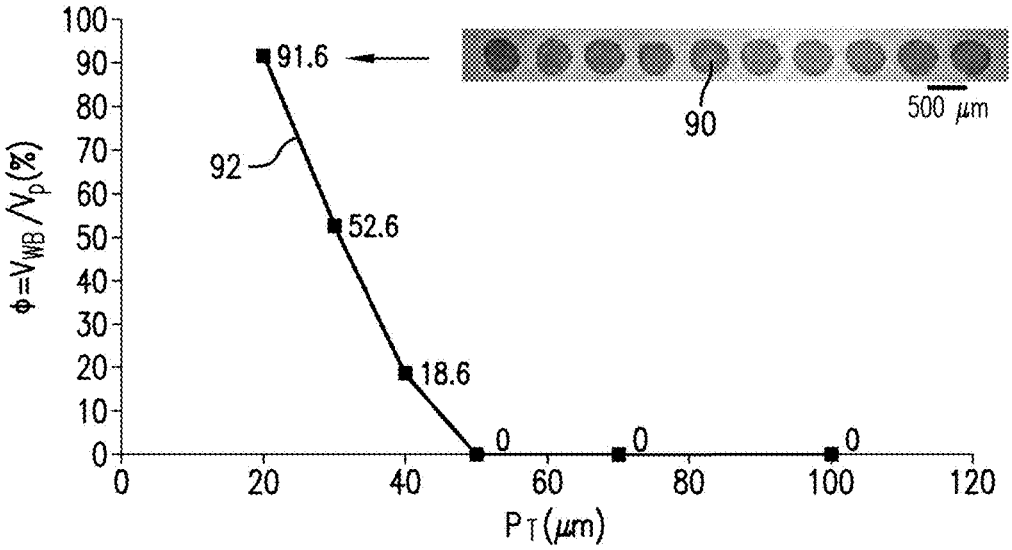
FIGS. 6A-6D depict aspects of an example of a method of evaluating the effect of pore throat sizes on water trapping.
Figure 6B:
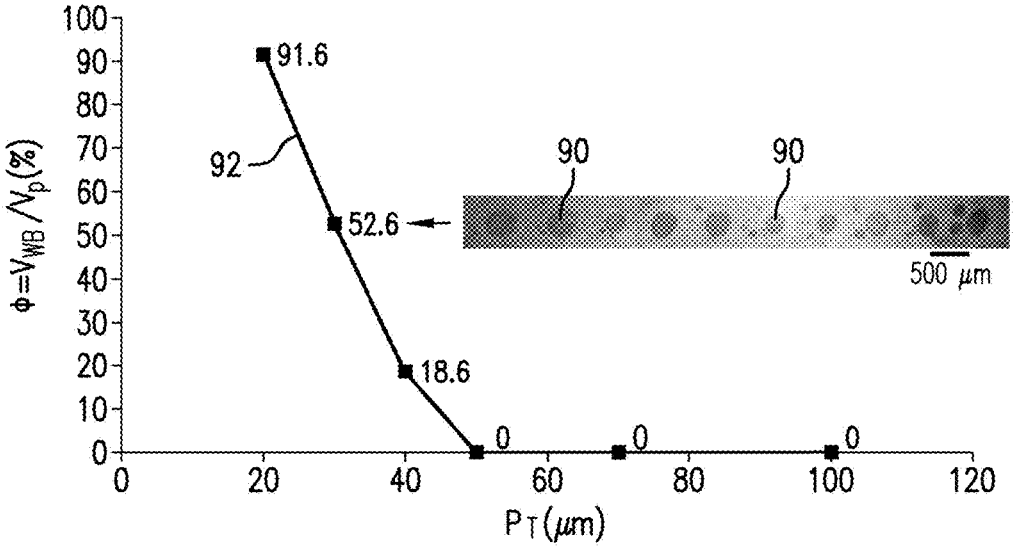
Figure 6C:
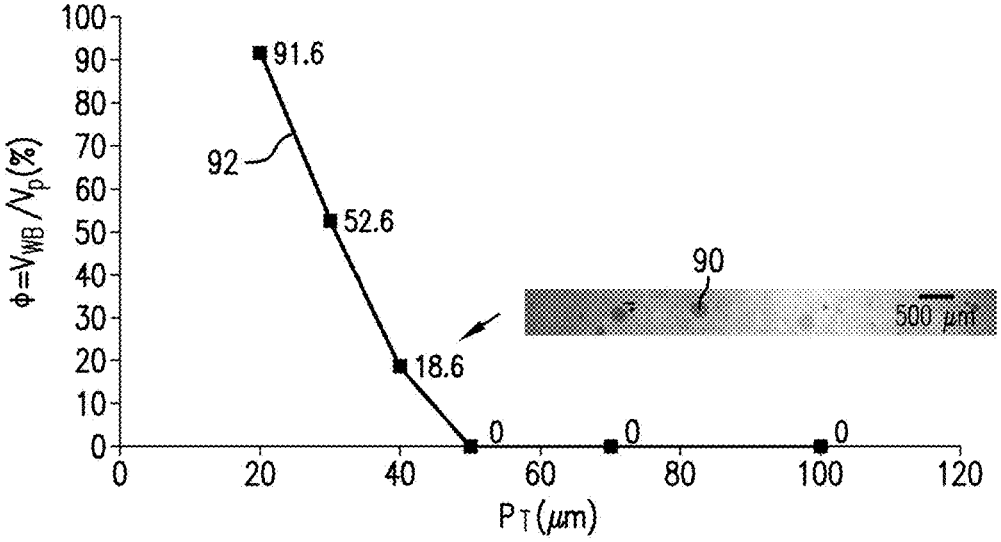
Figure 6D:
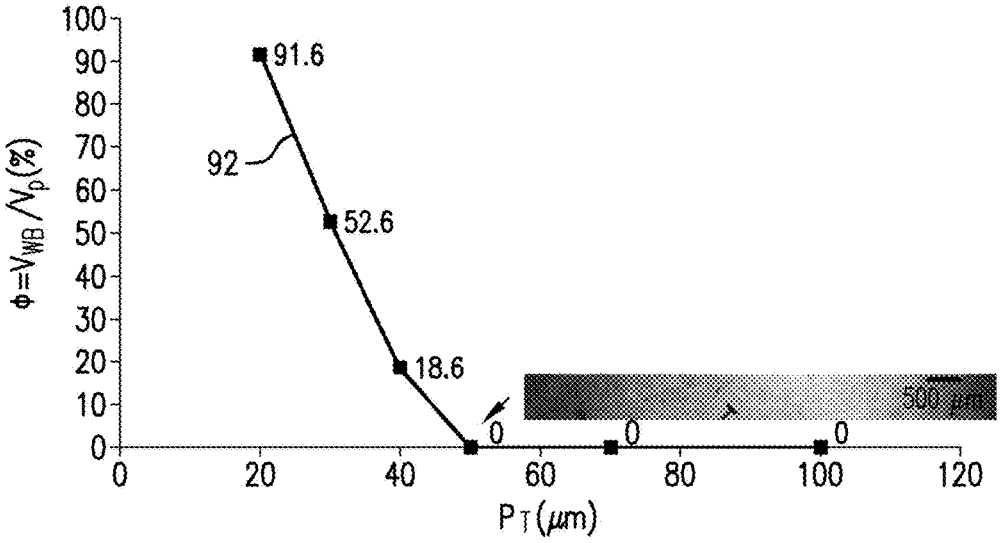

FIGS. 6A-6D show aspects of an example of a method of evaluating the effect of pore throat sizes on water trapping. To investigate the effect of pore throat, only the size of the pore throat ($P_T$) was varied from 20 to 100 μm with a fixed pore diameter ($P_d$) of 500 μm. FIG. 6A shows an mF channel having a $P_T$ of 20 μm, FIG. 6B shows an mF channel having a $P_T$ of 30 μm, FIG. 6C shows an mF channel having a $P_T$ of 40 μm, and FIG. 6A shows an mF channel having a $P_T$ of 50 μm. 2% green dyed water was injected at a flow rate Q of 0.5 μL/min (Q=0.5 μL/min) to displace oil. After oil displacement, reservoir fluid represented by silicon oil was used to clean up the water without any chemical treatment. The viscosity of the reservoir oil is defined based on a viscosity ratio λ, which is a ratio of the viscosity $\mu_W$ of the oil phase to the viscosity $\mu_{nw}$ of the water phase ($\lambda=\mu_w/\mu_{nw}=20$). In this example, the silicon oil has a viscosity that is 20 times higher than water, i.e., λ is 20. Note that the contour of the reservoir channel was not visible due to the change in the reflective index after saturation with silicon oil. Residual water 90 is visible in each channel, and the water blockage was calculated based on the proportion of the area or volume of the water relative to the area or volume of the poor space. The relationship between pore throat ($P_T$) and water blockage (Φ) is plotted as a curve 92.

As shown in FIGS. 6A-6D, more severe water blockage was found with the smaller pore throats. By increasing the size of the pore throat by 10 μm, significant reduction in the water block was observed under the controlled flow condition. The reservoir channel with the pore throat of 20 μm had 91.6% of water blockage, the channel with the pore throat of 30 μm had 52.6% blockage, and complete cleanup occurred with the pore throat of 50 μm under the same flow condition. The same trend—smaller pore throat resulting in higher water blockage—was observed for other oils with viscosity ratios (λ) from 1.5 to 30.

Figure 7A:
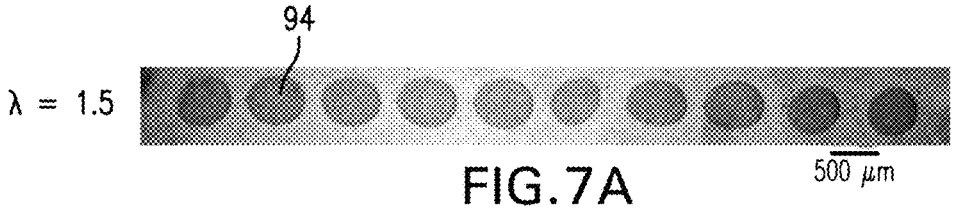
FIGS. 7A-7B depict aspects of an example of a method of evaluating the effect of reservoir fluid viscosity on water trapping.
Figure 7B:
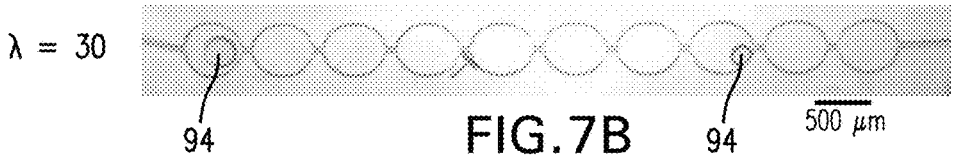

FIGS. 7A-7B show aspects of an example of a method of evaluating the effect of reservoir fluid (e.g., oil) viscosity on water trapping. To investigate the effect of reservoir fluid viscosity, the oil viscosity was varied from 1.5 to 30 cSt using isopar L, silicon oil with two different viscosities, and mineral oil. With the water phase, the viscosity index λ ranged from 1.5 to 30. Reservoir channels are shown after final oil displacement with two viscosities of oil, isopar L (λ=1.5) was displaced as shown in FIG. 7A, and mineral oil (λ=30) was displaced as shown in FIG. 7B under the controlled flow condition of Q=1 μL/min and the same pore geometry in both channels ($P_d$=500 μm, $P_T$=50 μm). The images of FIGS. 7A-7B show the remaining water 94. The oil with 30 times higher viscosity than the water phase (λ=30) gave significantly better cleanup of water blocks than the fluid combination where the oil had a similar viscosity to the water. Note that the interfacial tension between the mineral oil and water, and between the isopar L and water, were similar, γ=21.24 mN/m and 23.74 mN/m, respectively.

Figure 8:
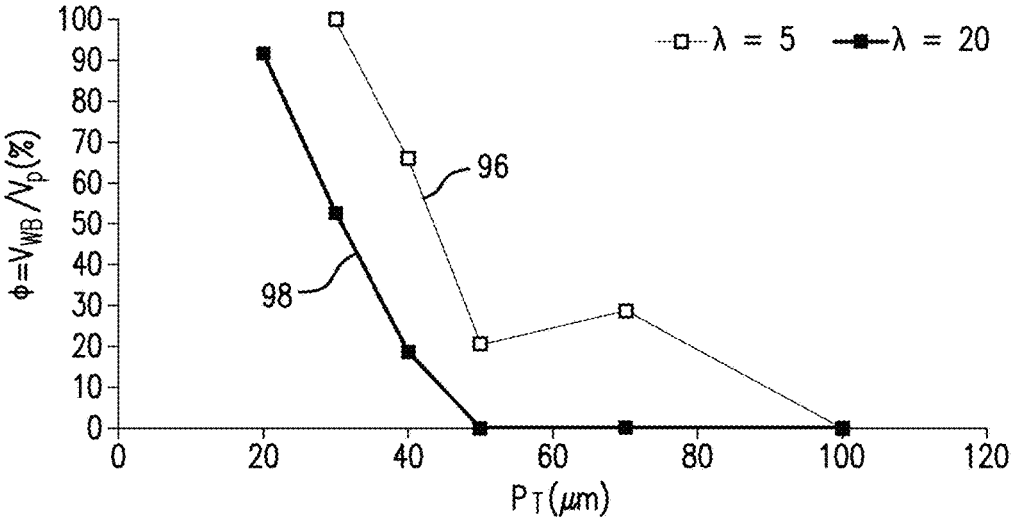
FIG. 8 depicts curves showing percentages of water block as a function of oil viscosities.

FIG. 8 shows the percentage of water block left in a reservoir channel as a function of the size of pore throats after final oil displacement with two viscosities of silicon oil (λ=5 and 20). Curves 96 and 98 show the water blockage Φ as a function of pore throat size for a viscosity ratio of 5 and 20, respectively. As shown, the lighter the oil, the more water blocks formed. This was performed at Q=1 μL/min with a fixed $P_d$=500 μm.

To understand the effect of viscosity on the water block cleanup, the capillary pressure and drawdown pressure may be calculated. Capillary pressure ($P_C$) is the pressure difference between the water block pressure ($P_{NW}$) and the oil phase pressure ($P_W$) and can be defined based on the interfacial tension (σ), the radius of curvature ($r_1$: pore radius, $r_2$: the height of the reservoir channel, 100 μm), and the contact angle (θ) as shown by equation 1 below. Regardless of the viscosity of the reservoir fluid, the capillary pressure is constant and only is subject to change by the variation in the curvature, interfacial tension, and wettability.

$$P_C = P_{NW} - P_W = 2\sigma\left(\frac{1}{r_s} + \frac{1}{r_s}\right)\cos\theta \tag{1}$$

Drawdown pressure ($P_{dd}$) is the pressure drop between the reservoir and the wellbore and can be estimated, e.g., using equation 2 below, based on the hydrodynamic resistance and the flow rate specifically for the reservoir channel. Drawdown pressure is subject to change by the channel resistance (R) which can be affected by viscosity of the fluid in the channel as presented in Eq. 3. The high reservoir oil viscosity contributes to increase the hydrodynamic channel resistance, and therefore, the drawdown pressure. This increased drawdown pressure enables to push the water more effectively, resulting in effective cleanup of water blocks.

$$P_{dd} = RQ \tag{2}$$

where $$R = \frac{12\mu L}{h^3 w}\left[1 - \sum_{n,odd}^{\infty} \frac{1}{n^5} \times \frac{192}{\pi^5} \times \frac{h}{w}\tanh\left(\frac{n\pi w}{2h}\right)\right]^{-1} \tag{3}$$

μ is the viscosity of the fluid in the channel, L is the length of the reservoir channel, h is the height of the channel, w is the width of the channel, and n is a positive integer. The microfluidic channel hydrodynamic resistance R in equation 3 was derived from the exact solution of Poiseuille flow for a rectangular channel.

From this, it can be calculate that, although $P_C$ is constant and not affected by fluid viscosity, the λ=1.5 system has drawdown pressure comparable to the capillary pressure ($P_c/P_{dd}$=0.93), resulting in a strong water block as shown by remaining water 94 in FIG. 7A. On the other hand, the drawdown pressure of the λ=30 system is 23 times higher than the capillary pressure ($P_c/P_{dd}$=0.043). If the drawdown pressure is higher than the capillary pressure, it can be exerted to mobilize the fluid and clean up the water blocks as shown in FIG. 7B.

FIGS. 9A-9D show aspects of an example of a method of evaluating the effect of flow rate on water trapping. To investigate the effect of fluid flow rate coming out of the reservoir, flow rate of the oil displacement was varied from 0.05 to 1 μL/min with controlled reservoir condition where mineral oil displaces 2% green dye water (λ=30) in the pore structure of $P_T$=50 μm and $P_d$=500 μm.

Figure 9A:
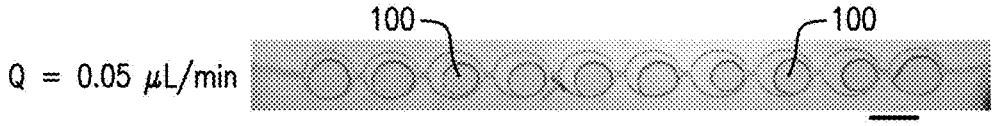
FIGS. 9A-9D depict aspects of an example of a method of evaluating the effect of flow rate on water trapping.
Figure 9B:
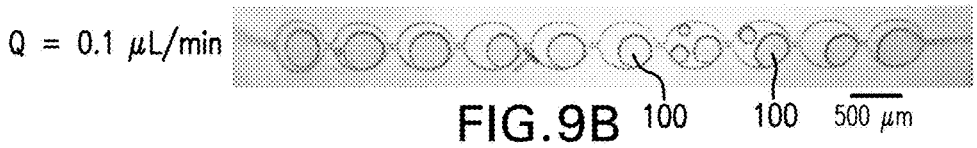
Figure 9C:
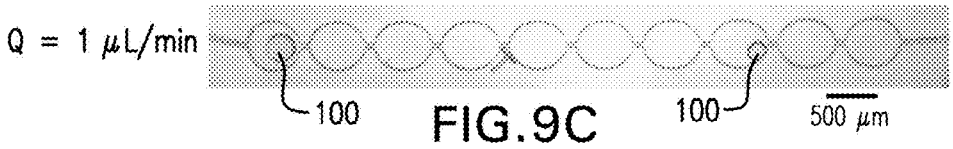
Figure 9D:
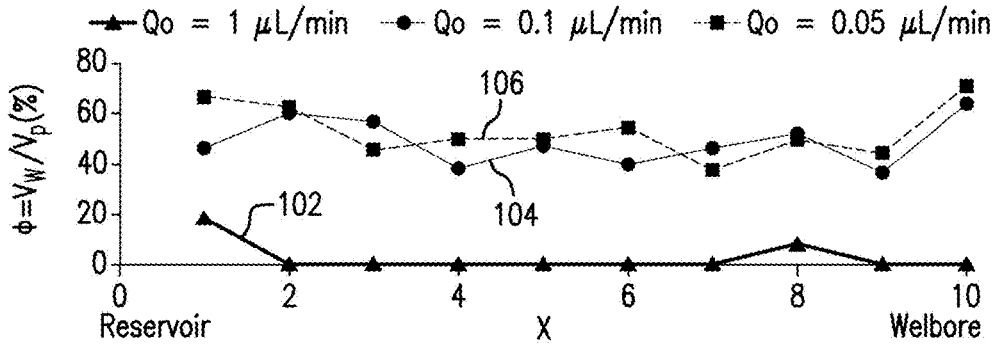

Severe water blockage formed with a low oil displacement rate at 0.05 μL/min, as shown by remaining water 100 in FIG. 9A. Effective water block cleanup was found with high flow rate of 1 μL/min (FIG. 9C). FIG. 9D shows the percentage of the water blockage in each pore from the reservoir to the wellbore for flow rates of 1 μL/min (curve 102), 0.1 μL/min (curve 104) and 0.05 μL/min (curve 106). On average, the flow rate of 0.05 μL/min left 53.2% water, the flow rate of 0.1 μL/min left 48.9% water, and the flow rate of 1 μL/min left 2.7% water. Considering the increase in drawdown pressure proportional to the flow rate, the reservoir displaced at a higher flow rate mobilized the fluid better, resulting in more effective evacuation of water.

Figure 10:
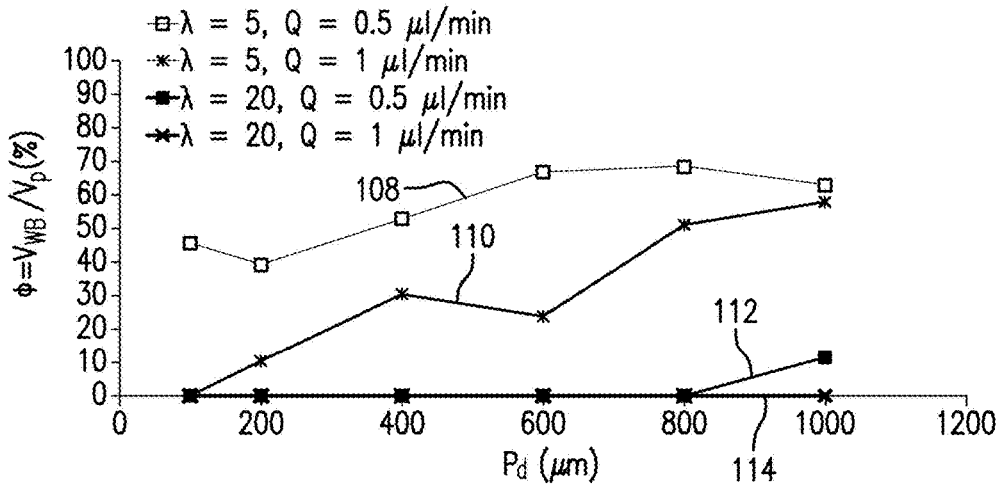
FIG. 10 depicts aspects of an example of a method of evaluating the effect of pore size on water trapping.

FIG. 10 shows aspects of an example of a method of evaluating the effect of pore size on water trapping. To investigate the effect of pore size on water block formation, the pore diameter was varied from 100 to 1000 μm with the $P_T$ fixed at 50 μm. FIG. 10 shows the water remaining in the channels as a function of reservoir pore diameter for two viscosities of silicon oil (λ=5 and 20) at two flow rates (0.5 and 1 μL/min) and two oil fluid viscosities (λ=0.5 and 1). Curve 108 is based on a viscosity ratio of 5 and a flow rate of 0.5 μL/min, curve 110 is based on a viscosity ratio of 5 and a flow rate of 1 μL/min, curve 112 is based on a viscosity ratio of 20 and a flow rate of 0.5 μL/min, and curve 114 is based on a viscosity ratio of 20 and a flow rate of 1 μL/min.

Starting from the high viscosity of silicon oil (λ=20) at a high displacement rate of Q=1 μL/min, no water block occurred regardless of the pore size. At a lower flow rate of Q=0.5 μL/min, a slight water blockage (11.7%) occurred in the largest pore ($P_d$=1000 μm) tested. With lighter oil (λ=5), water blocks formed at all pore sizes except the smallest pore ($P_d$=100 μm) at the high flow rate of Q=1 μL/min. The larger the pores, the higher the surface area accommodating water; therefore, more water was left in reservoirs with larger pores. The lighter oil displaced at lower rate of Q=0.5 μL/min left more water (40% or above) in all pores, compared to the result with higher flow rate of Q=1 μL/min. Therefore, for the flow condition tested in this example, the larger the pore, the higher chance of water block formation for low-viscosity oil (λ=5). But the effect of pore size was insignificant if the reservoir oil viscosity was comparably high (λ=20).

Figure 11:
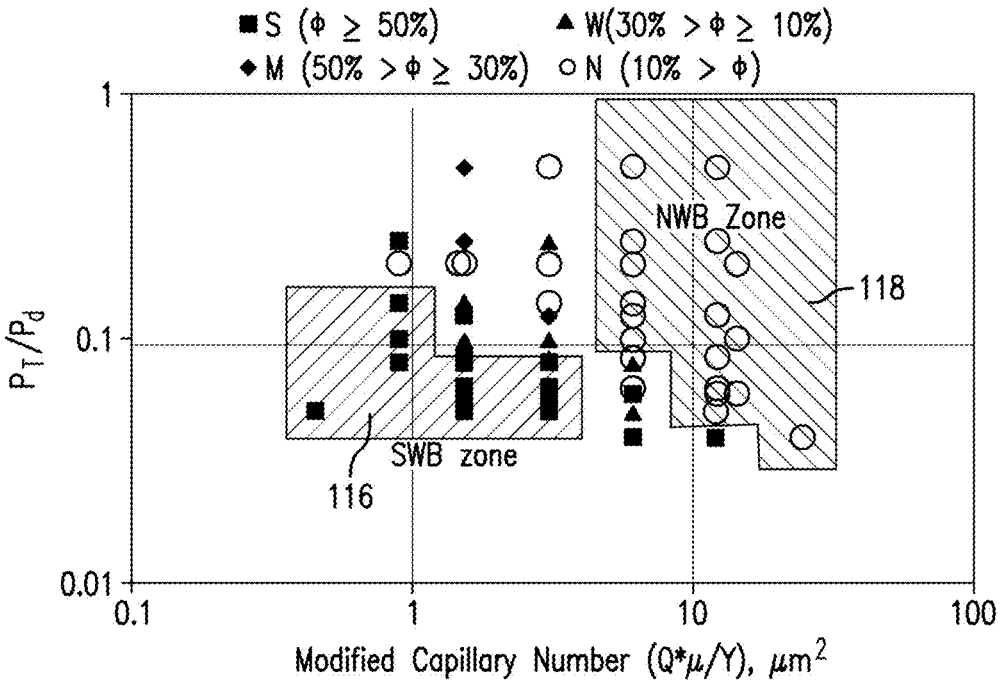
FIG. 11 depicts a water block map generated based on water blockage data collected for various flow conditions and reservoir parameters.

FIG. 11 shows a water block map generated based on water blockage data collected for various flow conditions and reservoir parameters, and without a chemical treatment, a water block map was plotted in FIG. 11 as a function of pore geometry index ($P_T/P_d$) and modified capillary number ($Ca^*=Q\mu/\gamma$). This map covers the majority of the reservoir parameters affecting water block formation tested in various examples: pore throat ($P_T$), pore diameter ($P_d$), oil flow rate (Q), oil viscosity (μ), and interfacial tension (IFT, γ). All the reservoir conditions were tested without any chemical treatment, and are presented in the map for various pore geometries ($P_T$=20 to 100 μm, $P_d$=100 to 1000 μm), oil flow rates (Q=0.5 to 1 μL/min), oil viscosities (λ=1.5, 5, 20, and 30 cSt) and interfacial tension values (γ=27.43 to 35.0 mN/m), using 2% green dye as the water phase and isopar L, silicon oil, and mineral oil as the oil phase. From the percentage of pore space containing water after oil displacement (Φ), the water blockage was categorized as severe (Φ≥50%), medium (50%≥Φ≥30%), weak (30%>Φ≥10%), or no water blockage (Φ<10%).

The water block map shows severe water blockages (SWB) with comparably low pore geometry index ($P_T/P_d \leq 0.14$) and low modified capillary number ($Ca^* \leq 3$), as shown in region 116. This agrees with the understanding that severe water blockage is more likely under reservoir conditions with either low $P_T$ or large $P_d$ and flow conditions with low displacement rate and low oil viscosity.

On the contrary, no water blockage (NWB) was found with comparably high $Ca^*$($Ca^* \geq 6$) as shown by region 118, implying that effective water block cleanup was rendered with the flow condition of high flow rate, high oil viscosity, or low IFT. NWB also was found with lower $Ca^*$($Ca^* \leq 3$) and higher pore geometry index ($P_T/P_d \geq 0.14$). Medium to weak water blockage occurred in the transitional boundary between the regions of SWB and NWB.

Figure 12A:
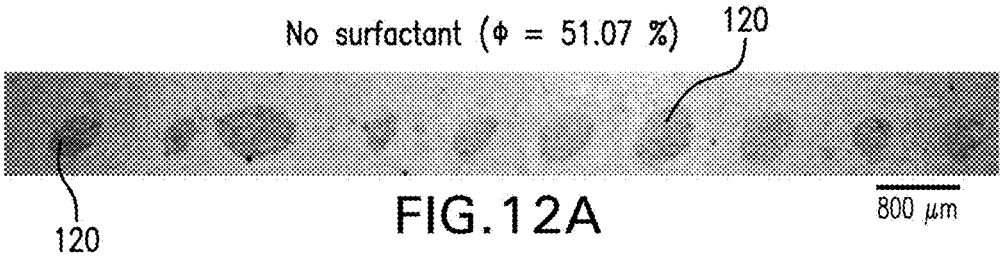
FIGS. 12A-12B depict aspects of an example of a method of evaluating the effect of surfactants on water trapping.
Figure 12B:
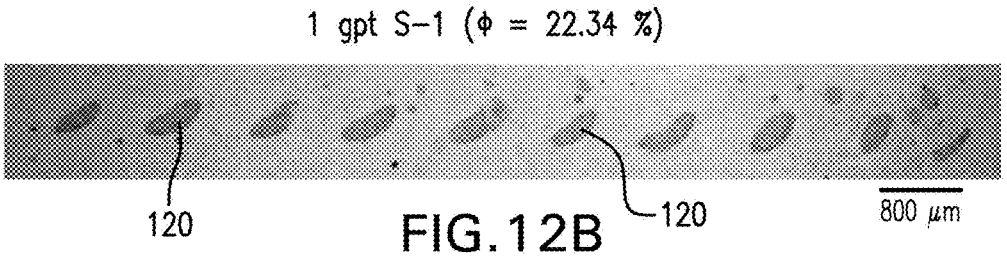
Figure 20:
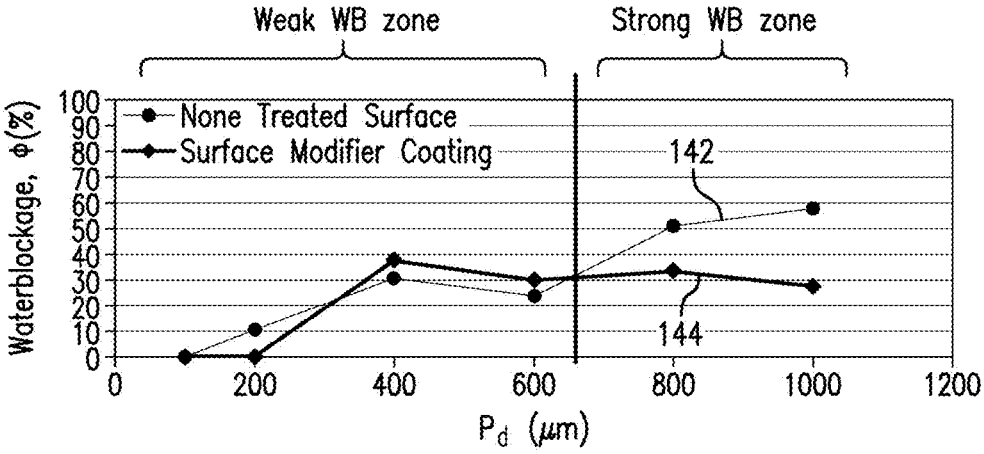
FIG. 20 depicts a comparison of water trapping for different surface coatings.

FIGS. 12A-12B through 20 illustrate examples of evaluations of various treatment chemicals and/or treatment chemical concentrations and their effects on water trapping. In these examples, chemical treatments using surfactants were performed for reservoir conditions identified as giving high water blockage to study their effectiveness in resolving fluid retention issues. Surfactants have been used in drilling and hydraulic fracturing to reduce interfacial tension between hydrocarbons and water-based stimulation fluid as the primary function to recover more treating fluid from the formation, leaving less damage and restoring the relative permeability to gas. Embodiments described herein improve understanding of how the flow profile develops when surfactant is used to mitigate water blocks, and whether a surfactant is always beneficial.

The methods and apparatus can thus be used to evaluate surfactant concentrations and determine desired or optimal concentrations. For example, to study the effect of a surfactant on water block removal, oil was used to displace dyed water with and without surfactants (referred to as surfactant S-1 and S-2) under conditions that have been shown to result in high water blockage, and the results compared.

FIGS. 12A-12B and 13A-13B show aspects of an example of a method of evaluating the effect of surfactants on water trapping and water block cleanup. Referring to FIGS. 12A-12B, silicon oil (λ=5) was injected at Q=1 μL/min to displace 2% green dye water in a geometry of $P_d$=800 μm and $P_T$=50 μm. Without a surfactant, 51.07% of the water remained (as shown by remaining water 120 of FIG. 12A). Adding 1 gpt of cationic microemulsion surfactant S-1 into the water phase, as shown in FIG. 12B, resulted in 22.34% of the water remaining (22.34% water blockage). The common field concentration of 1 gpt was enough to improve water block cleanup and recover more water from the reservoir. However, subsequent tests determined that the optimum surfactant concentration varies depending on the reservoir conditions such as the fluid property, flow rate, pore structure, and surfactant.

Figure 13A:
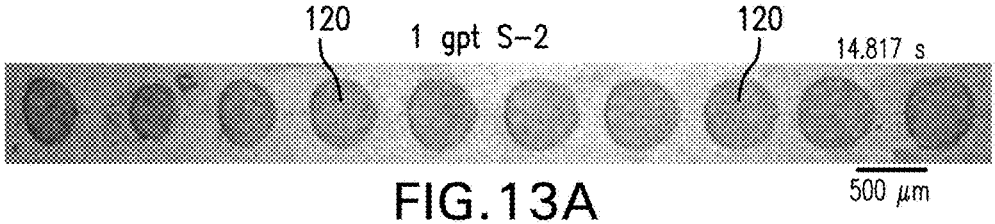
FIGS. 13A-13B depict aspects of an example of a method of evaluating the effect of surfactants on water trapping.
Figure 13B:
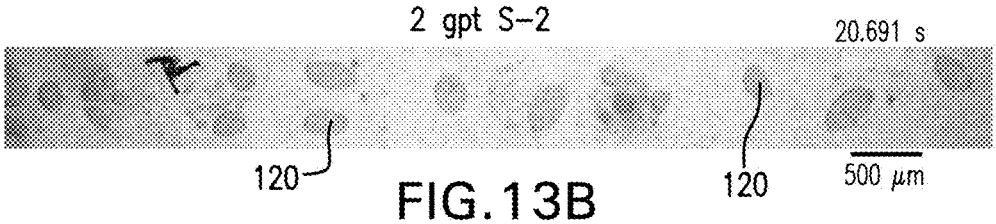

FIGS. 13A-13B show water blocks after isopar L displacement (λ=1.5) of green dyed water at $Q_o$=0.5 μL/min in a channel of $P_d$=500 μm, $P_T$=40 μm with surfactant S-2 for two different concentrations: (a) 1 gallon per thousand (gpt), and (b) 2 gpt. As shown in FIG. 13A, when isopar L was used as the displacement fluid instead of silicon oil, and reservoir and flow conditions were changed, 1 gpt of a different surfactant was not enough to cleanup water blocks. For the experiment associated with FIGS. 13A-13B, pore throat was smaller ($P_T$=40 μm), pores smaller ($P_d$=500 μm), and oil viscosity reduced, (λ=1.5) and flow rate reduced (0.5 μL/min) compared to the conditions for the experiment in FIGS. 12A-12B. Also, a different surfactant was used: a non-ionic enhanced flowback recovery surfactant, S-2. Although surfactant can improve water block, the optimum surfactant concentration for efficient water block mitigation can vary depending on the reservoir conditions.

Figure 14A:
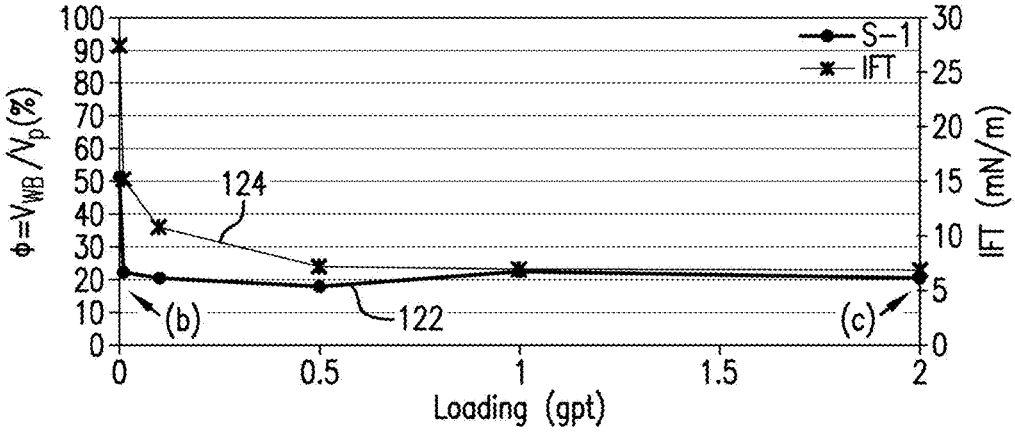
FIGS. 14A-14C depict aspects of an example of a method of evaluating the effect of surfactant concentration on water trapping.
Figure 14B:
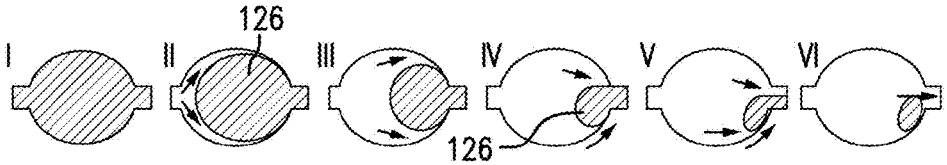
Figure 14C:
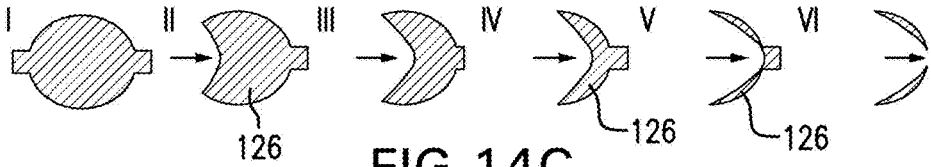

FIGS. 14A-14C show aspects of an example of a method of evaluating the effect of surfactant concentration on water trapping. To better understand surfactant performance versus loading, the concentration of S-1 surfactant in water phase was varied from 0.01 to 2 gpt. Silicon oil (λ=5) was used to displace the water phase at Q=1 μL/min in a channel geometry of $P_d$=800 μm and $P_T$=50 μm. Curve 122 of FIG. 14A shows the relationship between loading and water blocking percentage, and curve 124 shows the relationship between loading and IFT. FIG. 14B shows the behavior of water at different time intervals during displacement of water with a surfactant concentration of 0.01 gpt, where FIGS. 14B(I)-14B(VI) represent the amount of water 126 as successive time intervals. FIGS. 14C(I)-14C(VI) show the behavior of water at different time intervals during displacement of water 126 with a surfactant concentration of 2 gpt, where FIGS. 14C(I)-14C(VI) represent the amount of water 118 as successive time intervals.

For the reservoir condition tested as shown in FIGS. 14A-14C, about 50% of the water without surfactant was displaced; any surfactant concentration above 0.01 gpt reduced the water block down to ~20%, which is about a 60% improvement in cleanup compared to no surfactant treatment. As shown by curve 116, with only 0.01 gpt of surfactant S-1, the IFT drops from 27.425 mN/m to 15.215 mN/m, which was enough to cleanup the water block for the testing condition in FIGS. 14A-14C.

Although the water blockage with the various concentrations were similar for the testing condition of FIGS. 14A-14C, two different fluid mechanisms pushed the water out of the pores and trapped the water block residues, one mechanism for low (0.01 to 0.5 gpt) and one for high concentrations (1 and 2 gpt) of surfactant. Using surfactant concentration of 0.01 gpt as an example of the former, oil wetted the reservoir pore's wall and pushed the entire water block from the edge (arrows in FIG. 14B(II)). In this manner, the oil expelled the water block continuously (FIGS. 14B(III) and 14B(IV)). When most of the water was released from the pore (FIG. 14BV), the viscous drag exerted by the oil heading into the pore throat cut off the tail of the water slug, leaving it as residue in the pore (FIG. 14B(VI)).

In contrast, the high surfactant concentration (2 gpt) effectively reduced the IFT (6.89 mN/m) and thereby the Laplace pressure in the water block. Due to the low Laplace pressure in the water block, the oil flow pushed toward the center of the water phase in a parabolic flow profile (FIG. 14C(II) through 14C(V)), which was not plausible with low surfactant concentration or no surfactant. However, even with this flow profile, some water residue was left at the wall after oil displacement because the water at the edge of the pore throat (FIG. 14C(VI)) was disconnected from the main water stream when the oil reached the pore throat at high speed. This small residue was similar in volume to the block left with the low-surfactant concentration. This small residue precluded complete cleanup if surfactant was used for treatment.

Figure 15:
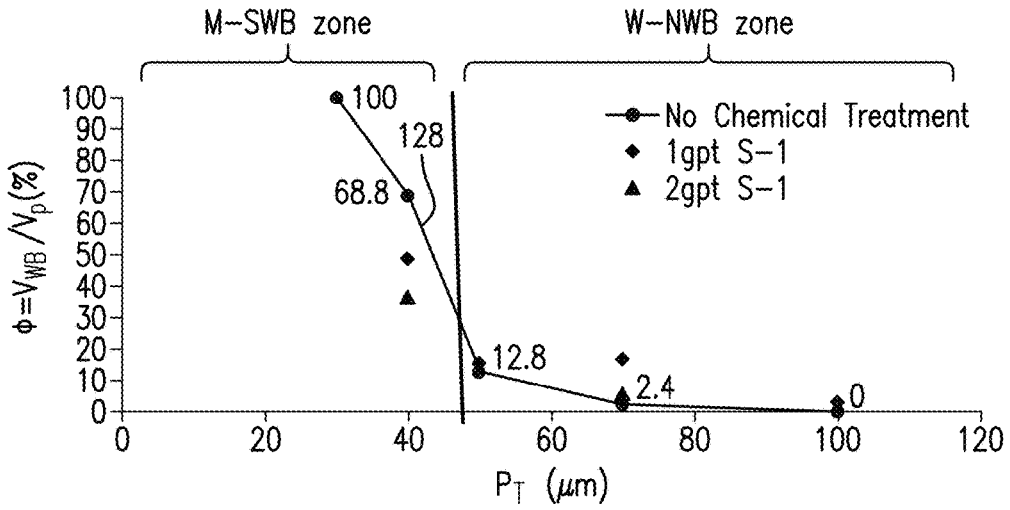
FIG. 15 depicts aspects of an example of a method of evaluating the effect of surfactants on the dependence of water trapping on pore throat size.

FIG. 15 shows aspects of an example of a method of evaluating the effect of surfactants on the dependence of water trapping on pore throat size. As discussed above, it was found that the smaller the pore throat, the more severe the water blockage formed without a chemical treatment. In this example, surfactant was added to the water flow for oil displacement under the same reservoir and flow conditions as the no-chemical experiment to investigate how surfactants affect water block.

Pore geometry with the pore size of $P_d$=500 μm was selected for the investigation and the pore throat varied from 30 to 100 μm. Silicon oil displaced 2% green dye water (λ=5) with surfactant S-1 of 0, 1, and 2 gpt at $Q_o$=1 μL/min. Curve 128 shows the original water blockage without chemical treatment, showing the more severe water blockage in channels with small pore throats and weaker water blockage in the channels with larger pore throats. These general categories can be split as medium to severe water block (M-SWB, D≥30%) and weak to no water block (W-NWB, Φ<30%).

The surfactant's effect on water block depended on the pore throat size. For the reservoir condition with medium to severe water block, the surfactant reduced the water block, with 2 gpt of surfactant slightly outperforming 1 gpt. However, the surfactant did not significantly affect water block in conditions of weak to no water block.

Figure 16:
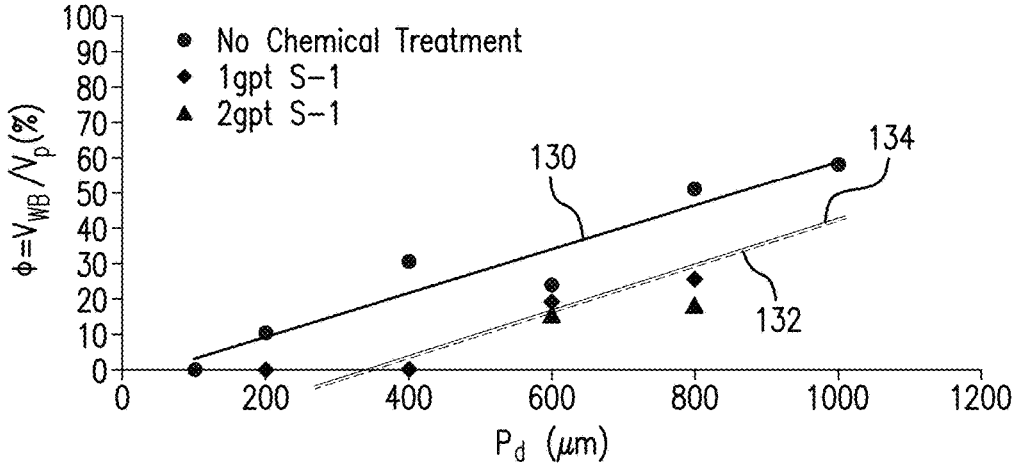
FIG. 16 depicts aspects of an example of a method of evaluating effects of surfactants on the relationship between water trapping and pore size.

FIG. 16 shows aspects of an example of a method of evaluating the effect of surfactants on the dependence of water trapping on pore size. To investigate how pore size affects surfactant mitigation of water block, the pore throat was fixed to $P_T$=50 μm and pore diameter varied from 100 to 1000 μm. Again, silicon oil was displaced in 2% green dye water (λ=5) at $Q_o$=1 μL/min with 0, 1, and 2 gpt of surfactant S-1. A water blockage curve 130 as a function of the pore size for water without surfactant shows that the larger the pore size, the more water blockage. Adding surfactant to the water improved water block cleanup regardless of the pore size or the severity of the original water blockage, as demonstrated by curves 132 and 134. Additionally, 2 gpt surfactant performed slightly better than 1 gpt.

Figure 17:
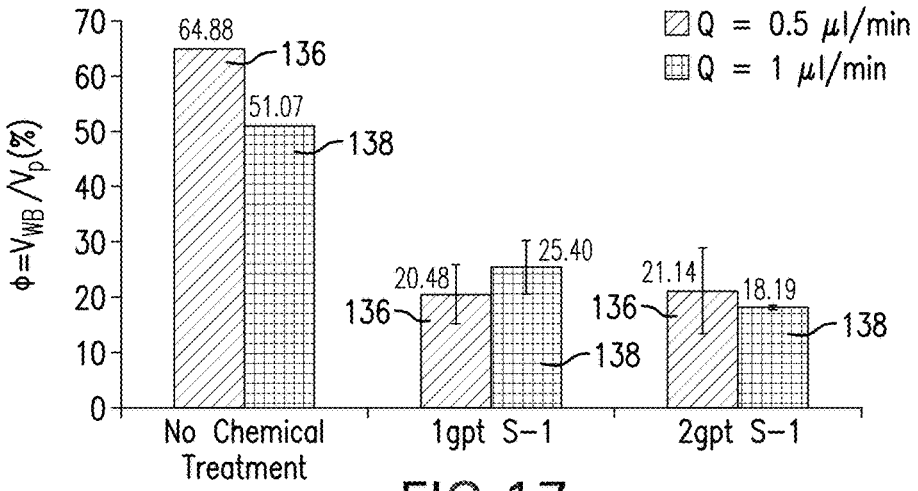
FIG. 17 depicts a graph showing an effect of a surfactant on the relationship between flow rate and water block trapping.

FIG. 17 depicts a graph resulting from an evaluation of the effect of a surfactant on the relationship between flow rate and water block trapping. To investigate the effect of reservoir flow rate on surfactant performance in mitigating water blocks, the flow rate of the reservoir fluid was varied between 0.5 and 1 μL/min. Silicon oil was displaced in 2% green dye water (λ=5) including 0, 1, and 2 gpt of surfactant S-1 in a channel of $P_T$=50 μm, $P_d$=800 μm.

Without chemical treatment, higher water blockage was observed with lower flow rate of Q=0.5 μL/min (represented by bars 136) than Q=1 μL/min (represented by bars 138). As expected, the surfactant improved water block cleanup significantly. Interestingly, however, surfactant's effect was independent of the oil flow rate.

Figure 18:
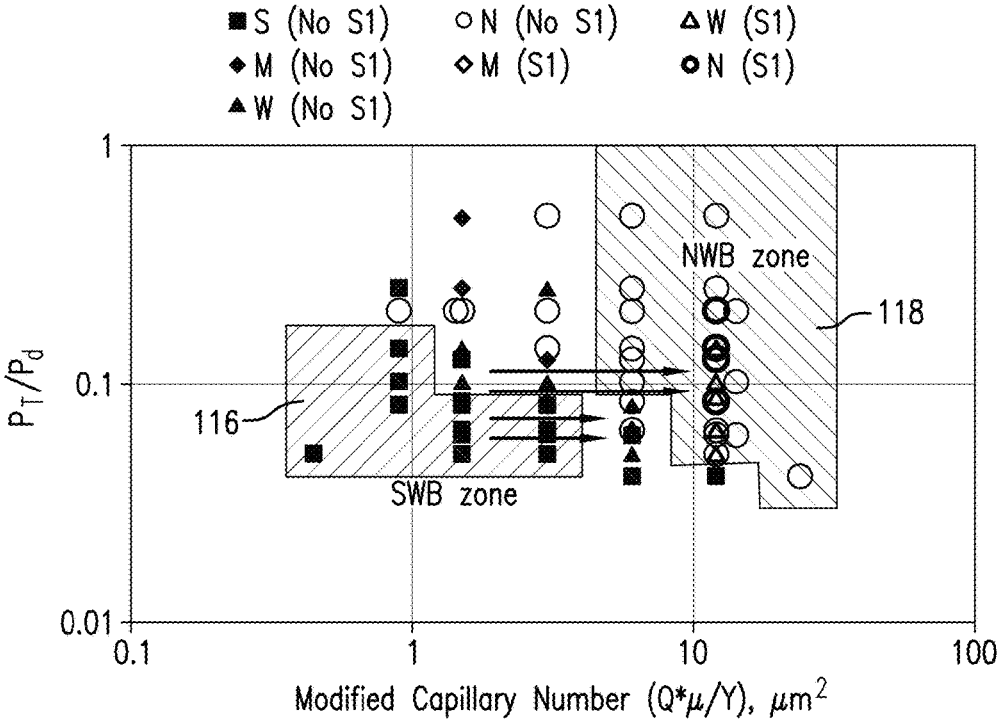
FIG. 18 depicts a water block map generated based on water blockage data collected using a surfactant for various flow conditions and reservoir parameters.

As discussed above, a surfactant can significantly reduce the interfacial tension and thereby mitigate water blocks, especially for challenging reservoir conditions. The medium to strong water blocks turned to mostly weak or no water blocks if surfactant was used under the same testing conditions. This is shown in the water block map of FIG. 18. The map confirms that the severe water blockage (SWB) reservoir conditions without chemical treatment shifted to the no water block (NWB) zone if surfactant was used for the same tested reservoir conditions. The significant reduction in IFT using surfactant contributed to an increase in modified capillary number, which mitigated the blockage. This indicates that for blockage-inducing reservoir conditions we cannot alter—such as low $P_T$, large $P_d$, low Q, low oil viscosity compared to the water phase—we can instead include surfactants in treatment fluids to mitigate water blocks.

Figure 19A:
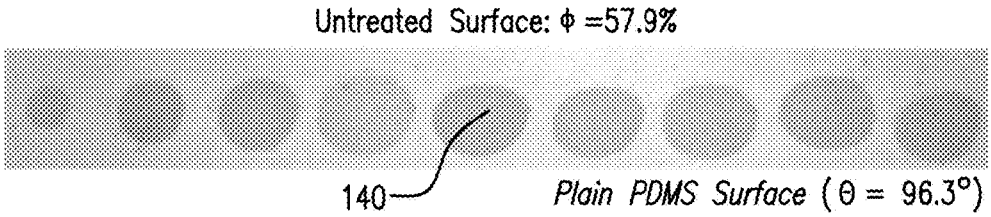
FIGS. 19A-19B depict aspects of an example of a method of evaluating the effects of a surface modifier on water trapping.
Figure 19B:
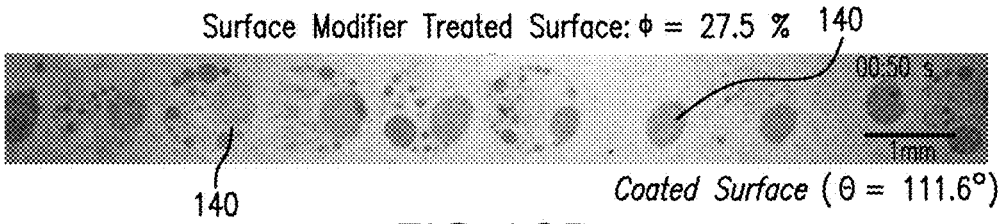

There have been many efforts to alter wettability by utilizing coating materials to make the reservoir surface super hydrophobic or make the reservoir have neutral wettability for better fluid recovery. FIGS. 19A-19B show aspects of an example of a method of evaluating the effects of hydrophobic coatings on water trapping. The performance of hydrophobic coating on water block removal was tested using silicon oil displacing 2% Green dye water (λ=5, λ is the viscosity ratio of oil to water) at Q=1 μL/min. The fluid channel used had a pore structure of $P_d$=1000 μm and $P_T$=50. As shown, the amount of remaining water 140 was less for a channel having a plain PDMS surface, than a channel having a hydrophobic coating.

Significant improvement in water block removal down to 27.5% was observed when the reservoir surface was coated with the hydrophobic coating for the tested reservoir and flow condition. To understand the performance of hydrophobic wettability treatment on water block removal better, the geometrical dependence and the optimum concentration has been investigated further.

To investigate the hydrophobic coating performance in different pore geometries, the pore throat was fixed to $P_T$=50 μm and pore diameter was varied from 100 to 1000 μm. Again, silicon oil was displaced in 2% green dye water ($\lambda$=5) at Q=1 μL/min. A water blockage curve 142 as a function of the pore size without hydrophobic treatment is shown in FIG. 20, along with a water blockage curve 144 as a function of the pore size for a treated channel. FIG. 20 shows that the larger the pore size, the more water blockage. By coating the pore surface with a hydrophobic material, water block cleanup was improved in larger pores (800 and 1000 μm) where the severity of the original water blockage was high without treatment. But for the smaller pores where weak water blockage was found in the original condition without treatment, the result showed similarly low water blockage even when the surface was treated.

Experimental results, including the examples discussed herein, confirm that the size of the pore throat plays a critical role in trapping and releasing fluid. Furthermore, displacing reservoir fluid at high rates, or with a higher oil viscosity, increases water cleanup efficiency. With this fundamental understanding, the reservoir conditions that require chemical treatment can be identified and quantified as to the degree of water blockage.

The systems and methods show that mitigation of water block is significantly improved by using a surfactant. However, the optimum surfactant loading varied depending on the reservoir conditions and the specific surfactant. Depending on the surfactant concentration, the flow profile changed, showing two different fluid mechanisms of water block trapping. Additionally, it was found that surfactant contributes to effective water block mitigation for the reservoir conditions that lead to strong water blocks without chemical treatment; however, surfactants have little effect in reservoir conditions that have minimal water blocks with plain water. Furthermore, if surfactant was used, the degree of water blockage reduction is independent from the oil displacement rate.

Lastly, water block maps such as the example discussed above show that the reservoir conditions giving strong water blockage are generally found with comparably low modified capillary number and comparably low pore geometry index, implying that more severe water blockage is found with low $P_T$ or high $P_R$ and low Q or low oil viscosity. However, this example of the maps discussed above also shows that such problematic reservoir conditions, which cannot be artificially modified, can be mitigated by reducing IFT using surfactant to mitigate water blocks.

These new findings expand the industry's understanding of the fluid mechanics behind residual fluid trapping, capillary effects, and the implications for engineered fracturing fluid systems.

Set forth are some embodiments of the foregoing disclosure:

Embodiment 1

A method of evaluating fluid trapping in an earth formation, the method comprising injecting a water-based fluid into at least one fluid channel fabricated on a substrate, the at least one fluid channel having a pore structure configured to represent a condition of an earth formation subject to an energy industry operation, the at least one fluid channel including a plurality of pores having a selected diameter and connected by pore throats; injecting oil into an inlet of the at least one fluid channel until at least a selected amount of the injected oil exits the channel; imaging the fluid channel and determining an amount of remaining fluid in the fluid channel after injection of the oil, the remaining fluid selected from at least one of an amount of the oil remaining in the fluid channel and an amount of the water-based fluid remaining in the fluid channel; estimating a proportion of the total volume of the fluid channel occupied by the remaining fluid to determine an amount of fluid trapping in the pore structure; and analyzing the amount of fluid trapping, wherein analyzing includes at least one of: determining whether a chemical treatment is to be included as part of the energy industry operation, and determining an effectiveness of the water-based fluid for use in the energy industry operation based on the proportion.

Embodiment 2

The method of any prior embodiment, further comprising, prior to injecting the water-based fluid, injecting an initial amount of oil into the fluid channel to saturate the fluid channel, wherein injecting the water-based fluid causes the initial amount of oil to be substantially forced out of the channel.

Embodiment 3

The method of any prior embodiment, wherein the water-based fluid is at least one of a hydraulic fracturing fluid and an enhanced oil recovery (EOR) fluid, and the energy industry operation is at least one of a hydraulic fracturing operation and an EOR operation.

Embodiment 4

The method of any prior embodiment, wherein the water-based fluid includes an additive that modifies interfacial properties and/or enhances the performance of other additives to reduce water trapping in porous media.

Embodiment 5

The method of any prior embodiment, wherein the at least one fluid channel is a plurality of fluid channels, each of the plurality of fluid channels having a separate inlet and outlet, each of the plurality of fluid channels having a different pore structure.

Embodiment 6

The method of any prior embodiment, wherein injecting the water-based fluid, injecting the oil, imaging the fluid channel and determining an amount of fluid trapping is repeated for each of the plurality of fluid channels, and analyzing includes determining an effect of changes in the pore structure on the effectiveness of the water-based fluid.

Embodiment 7

The method of any prior embodiment, wherein determining the amount includes estimating an area of the pores occupied by the amount of the remaining fluid.

Embodiment 8

The method of any prior embodiment, further comprising, prior to injecting the water-based fluid, injecting an amount of a surface modifier into the fluid channel to coat surfaces of the pores, and evaluating includes determining an effectiveness of the surface modifier in reducing the fluid trapping.

Embodiment 9

The method of any prior embodiment, wherein the water-based fluid includes a concentration of a surfactant, and evaluating includes determining whether the concentration is sufficient to effect a desired reduction in the amount of the water-based fluid remaining in the fluid channel.

Embodiment 10

The method of any prior embodiment, wherein injecting the water-based fluid, injecting the oil, imaging the fluid channel and determining an amount of fluid trapping is repeated for a plurality of different concentrations of the surfactant.

Embodiment 11

A system for evaluating fluid trapping in an earth formation, the system comprising: a substrate having at least one fluid channel fabricated thereon, the at least one fluid channel having a pore structure configured to represent a condition of an earth formation subject to an energy industry operation, the at least one fluid channel including a plurality of pores having a selected diameter and connected by pore throats; an injection device configured to inject a water-based fluid into on a substrate, and subsequently inject oil into an inlet of the at least one fluid channel until at least a selected amount of the injected oil exits the channel; an imaging device configured to image the fluid channel and determine an amount of remaining fluid in the fluid channel after injection of the oil, the remaining fluid selected from at least one of an amount of the oil remaining in the fluid channel and an amount of the water-based fluid remaining in the fluid channel; and a processor configured to perform: estimating a proportion of the total volume of the fluid channel occupied by the remaining fluid to determine an amount of fluid trapping in the pore structure, the amount of fluid trapping analyzed to determine at least one of: whether a chemical treatment is to be included as part of the energy industry operation, and an effectiveness of the water-based fluid for use in the energy industry operation based on the proportion.

Embodiment 12

The system of any prior embodiment, wherein the injection device is configured to, prior to injecting the water-based fluid, inject an initial amount of oil into the fluid channel to saturate the fluid channel, wherein injecting the water-based fluid causes the initial amount of oil to be substantially forced out of the channel.

Embodiment 13

The system of any prior embodiment, wherein the water-based fluid is a hydraulic fracturing fluid and the energy industry operation is a hydraulic fracturing operation.

Embodiment 14

The system of any prior embodiment, wherein the water-based fluid includes an additive that modifies interfacial properties and/or enhances performance of other additives to reduce water trapping in porous media.

Embodiment 15

The system of any prior embodiment, wherein the at least one fluid channel is a plurality of fluid channels, each of the plurality of fluid channels having a separate inlet and outlet, each of the plurality of fluid channels having a different pore structure.

Embodiment 16

The system of any prior embodiment, wherein the injection device is configured to inject the water-based fluid, inject the oil, image the fluid channel for each of the plurality of fluid channels, the processor is configured to determine an amount of fluid trapping for each of the plurality of fluid channels.

Embodiment 17

The system of any prior embodiment, wherein the processor is configured to determine the amount based on estimating an area of the pores occupied by the amount of the remaining fluid.

Embodiment 18

The system of any prior embodiment, wherein the injection device is configured to, prior to injecting the water-based fluid, inject an amount of a surface modifier into the fluid channel to coat surfaces of the pores, and the processor is configured to determine an effectiveness of the surface modifier in reducing the fluid trapping.

Embodiment 19

The system of any prior embodiment, wherein the water-based fluid includes a concentration of a surfactant, and the processor is configured to determine whether the concentration is sufficient to effect a desired reduction in the amount of the water-based fluid remaining in the fluid channel.

Embodiment 20

The system of any prior embodiment, wherein the injection device is configured to inject the water-based fluid, inject the oil, and image the fluid channel for each of a plurality of different concentrations of the surfactant.

The systems and methods described herein provide various advantages over prior art techniques. The systems and methods described herein allow for a systematic analysis of formation pore structures and fluids to visualize and understand the residual water blocking process of fracturing fluids and other fluids. The embodiments described herein address the limitations of core- and field-based studies in discerning water trapping mechanisms at the pore scale.

Embodiments described herein allow for clear visualizations of the fluid displacement and the water block trapping process in the micro-pore scale, which has not yet been possible or feasible at the macro scale of current oil and gas laboratory settings. In addition, the embodiments allow for precise control of testing parameters including formation wettability, reservoir/stimulation fluid properties, flow rate, and reservoir pore-space geometry.

One or more aspects of the present invention can be included in an article of manufacture (e.g., one or more computer program products) having, for instance, computer usable media. The media has therein, for instance, computer readable instructions, program code means or logic (e.g., code, commands, etc.) to provide and facilitate the capabilities of the present invention. The article of manufacture can be included as a part of a computer system or provided separately. These instructions may provide for equipment operation, control, data collection and analysis and other functions deemed relevant by a system designer, owner, user or other such personnel, in addition to the functions described in this disclosure.

One example of an article of manufacture or a computer program product for executing the methods described is a processing device or system such as the system 10, the processing unit 36 and/or the analysis unit 58. A computer program product includes, for instance, one or more computer usable media to store computer readable program code means or logic thereon to provide and facilitate one or more aspects of the methods and systems described herein. The medium can be an electronic, magnetic, optical, electromagnetic, infrared or semiconductor system (or apparatus or device) or a propagation medium. Example of a computer readable medium include a semiconductor or solid state memory, magnetic tape, a removable computer diskette, a random access memory (RAM), a read-only memory (ROM), a rigid magnetic disk and an optical disk. Examples of optical disks include compact disk-read only memory (CD-ROM), compact disk-read/write (CD-R/W) and DVD.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of evaluating fluid trapping in an earth formation, the method comprising injecting a water-based fluid into at least one fluid channel fabricated on a substrate, the at least one fluid channel having a pore structure configured to represent a condition of an earth formation subject to an energy industry operation, the at least one fluid channel including a plurality of pores having a selected diameter and connected by pore throats;

injecting oil into an inlet of the at least one fluid channel until at least a selected amount of the injected oil exits the channel;

imaging the fluid channel and determining an amount of remaining fluid in the fluid channel after injection of the oil, the remaining fluid selected from at least one of an amount of the oil remaining in the fluid channel and an amount of the water-based fluid remaining in the fluid channel;

estimating a proportion of the total volume of the fluid channel occupied by the remaining fluid to determine an amount of fluid trapping in the pore structure, the amount of fluid trapping based on a percentage of at least one of the water-based fluid and the oil remaining in the at least one fluid channel; and analyzing the amount of fluid trapping, wherein analyzing includes determining whether a chemical treatment is to be included as part of the energy industry operation based on the amount of fluid trapping in the pore structure.

2. The method of claim 1, further comprising, prior to injecting the water-based fluid, injecting an initial amount of oil into the fluid channel to saturate the fluid channel, wherein injecting the water-based fluid causes the initial amount of oil to be substantially forced out of the channel.

3. The method of claim 1, wherein the water-based fluid is at least one of a hydraulic fracturing fluid and an enhanced oil recovery (EOR) fluid, and the energy industry operation is at least one of a hydraulic fracturing operation and an EOR operation.

4. The method of claim 1, wherein the water-based fluid includes an additive that modifies interfacial properties and/or enhances the performance of other additives to reduce water trapping in porous media.

5. The method of claim 1, wherein determining the amount includes estimating an area of the pores occupied by the amount of the remaining fluid.

6. The method of claim 1, further comprising, prior to injecting the water-based fluid, injecting an amount of a surface modifier into the fluid channel to coat surfaces of the pores, and evaluating includes determining an effectiveness of the surface modifier in reducing the fluid trapping.

7. The method of claim 1, wherein the at least one fluid channel is a plurality of fluid channels, each of the plurality of fluid channels having a separate inlet and outlet, each of the plurality of fluid channels having a different pore structure.

8. The method of claim 7, wherein injecting the water-based fluid, injecting the oil, imaging the fluid channel and determining an amount of fluid trapping is repeated for each of the plurality of fluid channels, and analyzing includes determining an effect of changes in the pore structure on the effectiveness of the water-based fluid.

9. The method of claim 1, wherein the water-based fluid includes a concentration of a surfactant, and evaluating includes determining whether the concentration is sufficient to effect a desired reduction in the amount of the water-based fluid remaining in the fluid channel.

10. The method of claim 9, wherein injecting the water-based fluid, injecting the oil, imaging the fluid channel and determining an amount of fluid trapping is repeated for a plurality of different concentrations of the surfactant.

11. A system for evaluating fluid trapping in an earth formation, the system comprising:

a substrate having at least one fluid channel fabricated thereon, the at least one fluid channel having a pore structure configured to represent a condition of an earth formation subject to an energy industry operation, the at least one fluid channel including a plurality of pores having a selected diameter and connected by pore throats;

an injection device configured to inject a water-based fluid into on a substrate, and subsequently inject oil into an inlet of the at least one fluid channel until at least a selected amount of the injected oil exits the channel;

an imaging device configured to image the fluid channel and determine an amount of remaining fluid in the fluid channel after injection of the oil, the remaining fluid selected from at least one of an amount of the oil remaining in the fluid channel and an amount of the water-based fluid remaining in the fluid channel; and a processor configured to perform:

estimating a proportion of the total volume of the fluid channel occupied by the remaining fluid to determine an amount of fluid trapping in the pore structure, the amount of fluid trapping based on a percentage of at least one of the water-based fluid and the oil remaining in the at least one fluid channel, the amount of fluid trapping analyzed to determine whether a chemical treatment is to be included as part of the energy industry operation based on the amount of fluid trapping in the pore structure.

12. The system of claim 11, wherein the injection device is configured to, prior to injecting the water-based fluid, inject an initial amount of oil into the fluid channel to saturate the fluid channel, wherein injecting the water-based fluid causes the initial amount of oil to be substantially forced out of the channel.

13. The system of claim 11, wherein the water-based fluid is a hydraulic fracturing fluid and the energy industry operation is a hydraulic fracturing operation.

14. The system of claim 11, wherein the water-based fluid includes an additive that modifies interfacial properties and/or enhances performance of other additives to reduce water trapping in porous media.

15. The system of claim 11, wherein the processor is configured to determine the amount based on estimating an area of the pores occupied by the amount of the remaining fluid.

16. The system of claim 11, wherein the injection device is configured to, prior to injecting the water-based fluid, inject an amount of a surface modifier into the fluid channel to coat surfaces of the pores, and the processor is configured to determine an effectiveness of the surface modifier in reducing the fluid trapping.

17. The system of claim 11, wherein the at least one fluid channel is a plurality of fluid channels, each of the plurality of fluid channels having a separate inlet and outlet, each of the plurality of fluid channels having a different pore structure.

18. The system of claim 17, wherein the injection device is configured to inject the water-based fluid, inject the oil, image the fluid channel for each of the plurality of fluid channels, the processor is configured to determine an amount of fluid trapping for each of the plurality of fluid channels.

19. The system of claim 11, wherein the water-based fluid includes a concentration of a surfactant, and the processor is configured to determine whether the concentration is sufficient to effect a desired reduction in the amount of the water-based fluid remaining in the fluid channel.

20. The system of claim 19, wherein the injection device is configured to inject the water-based fluid, inject the oil, and image the fluid channel for each of a plurality of different concentrations of the surfactant.

* * * * *